US005655197A

United States Patent [19]

Okada et al.

[11] Patent Number: 5,655,197

[45] Date of Patent: Aug. 5, 1997

[54] DEVELOPING DEVICE

[75] Inventors: Hideki Okada; Yoshiro Koga; Takashi Suzuki; Yoshihiro Nakashima; Takehiko Okamura, all of Nagano, Japan

[73] Assignee: Seiko Epson Corporation, Tokyo, Japan

[21] Appl. No.: 547,390

[22] Filed: Oct. 24, 1995

Related U.S. Application Data

[62] Division of Ser. No. 70,198, Jun. 2, 1993, Pat. No. 5,557, 060.

[30] Foreign Application Priority Data

Jun. 2, 1992 [JP] Japan ..... 4-141424
May 11, 1993 [JP] Japan ..... 5-109028

[51] Int. Cl.[6] ..... G03G 15/06

[52] U.S. Cl. ..... 118/661; 355/259

[58] Field of Search ..... 355/245, 259, 355/261; 118/651, 653, 661

[56] References Cited

U.S. PATENT DOCUMENTS

| | | | |
|---|---|---|---|
| 4,930,438 | 6/1990 | Demizu et al. | 118/651 |
| 4,967,231 | 10/1990 | Hosoya et al. | 355/219 |
| 5,012,289 | 4/1991 | Aldrich et al. | 355/260 |
| 5,086,728 | 2/1992 | Kinoshita | 118/653 |
| 5,097,294 | 3/1992 | Nishio et al. | 355/245 |
| 5,142,330 | 8/1992 | Hirano et al. | 355/259 |
| 5,170,213 | 12/1992 | Yamaguchi et al. | 355/246 |
| 5,177,323 | 1/1993 | Kohyama | 118/653 |
| 5,179,414 | 1/1993 | Bhagat | 355/259 |
| 5,270,786 | 12/1993 | Kikuchi et al. | 355/261 |
| 5,489,747 | 2/1996 | Takenaka et al. | 118/653 |

FOREIGN PATENT DOCUMENTS

| | | | |
|---|---|---|---|
| 0 257 178 | 3/1988 | European Pat. Off. . | |
| 0 387 096 | 9/1990 | European Pat. Off. . | |
| 0 390 605 | 10/1990 | European Pat. Off. . | |
| 0 400 572 | 12/1990 | European Pat. Off. . | |
| 0 442 472 | 8/1991 | European Pat. Off. . | |
| 528045 | 2/1993 | European Pat. Off. . | |
| 3621457A1 | 1/1987 | Germany . | |
| 55-77764 | 6/1980 | Japan . | |
| 59-231560 | 12/1984 | Japan . | |
| 62-218973 | 9/1987 | Japan | 355/259 |
| 1756856 | 1/1987 | U.S.S.R. . | |
| 1351814 | 5/1974 | United Kingdom . | |
| 2 163 371 | 2/1986 | United Kingdom . | |
| 2 197 227 | 5/1988 | United Kingdom . | |

*Primary Examiner*—Robert Beatty
*Attorney, Agent, or Firm*—Sughrue, Mion, Zinn, Macpeak & Seas

[57] ABSTRACT

A developing device including a supply member pressingly contacted with a toner carrier, wherein the supply member has a hardness which greater than that of the toner carrier. The supply member is rotated in the same direction as the toner carrier to conduct the peeling and supply of toner. A plate spring-like regulation member is pressed against the toner carrier to charge the toner to a predetermined polarity and thin the toner into one or two layers. The toner carrier is made of a foam material.

30 Claims, 6 Drawing Sheets

DEVELOPING DEVICE

This is a divisional of application Ser. No. 08/070,198 filed Jun. 2, 1993 now U.S. Pat. No. 5,557,060.

BACKGROUND OF THE INVENTION

1. Field of the Invention

This invention relates to a developing device which is used in an electrophotography system or the like, and more particularly to a developing device for developing an electrostatic latent image formed on a latent image carrier, using toner. More particularly, the invention relates to a developing device for performing the developing process while forming a uniform and thin toner layer on a toner carrier.

2. Prior Art

As disclosed in Unexamined Japanese patent publications Nos. SHO 47-13,088 and SHO 47-13,089, in a conventional developing device, a toner carrier which is lined by a foamed member and in which a soft electrically conductive layer is formed on the foamed member carries toner to develop a latent image.

Japanese Unexamined patent publication No. SHO 55-77,764 discloses another developing device in which a toner carrier using a foam material carries toner to develop a latent image.

Japanese unexamnined patent publication No. SHO 52-125,340 discloses a further developing device which comprises a toner carrier having a rubber surface for carrying toner and developing a latent image, and an adjust member for eliminating level irregularities of a toner layer on the toner carrier after the developing process.

Japanese Unexamined patent publication No. HEI 3-155,575 discloses a still further developing device in which the surface layer of a supply member is formed by polyurethane foam and the cell diameter of the polyurethane foam is set to be 30 to 200 μm.

Japanese Unexamined patent publication No. HEI 4-109,266 discloses a still further developing device in which an irregularity area is formed on the surface of a supply member, and the following relationships exist between a rotational velocity $V_1$ [mm/sec] of a toner carrier, a rotational velocity $V_2$ [mm/sec] of the supply member, a width a [mm] in the rotation direction of the contacting area between the toner carrier and the supply member, and the number of convex portions per unit length [portions/mm] of the irregularity area in the rotation direction of the supply member:

$$V_2 \geqq V_1/4,$$

and $$6 \leqq N*a*(V_1+V_2)/V_1 \leqq 40$$

In the prior art disclosed in Japanese Unexamined patent publications Nos. SHO 47-13,088 and SHO 47-13,089, however, tones is supplied with its gravity to the carrier, and therefore the following problems are produced: The development hysteresis (irregularities of a toner layer produced by an image pattern which has been used in immediately previous developing process) causes the density unevenness and a ghost. When white patterns where no image is formed are continued, the toner carry amount on the toner carrier is gradually increased to cause the density unevenness or the formation of a toner image in a nonimage area (background fogging). When the toner carry amount is changed, the rotation of the toner carrier changes in torque or rotation number, thereby producing the printing jitters. Accordingly, such a developing device has drawbacks that the density unevenness often occurs, that the resolution or definition is low, that images having many jitters are obtained, and that the reliability is low.

In the prior art disclosed in Japanese Unexamined patent publication No. SHO 55-77,764, a toner layer is formed (predevelopment) by applying a bias voltage between the toner carrier using a foam material and the supply member. This is effective in stably forming a toner layer on the toner carrier. However, this additionally requires a bias voltage source, causing the size of the developing device to be enlarged.

In the prior art disclosed in Japanese patent publication No. SHO 52-125,340, the provision of the adjust member can reduce the degree of the density unevenness or ghost due to the development hysteresis. When while no image is formed are continued, however, the toner carry amount is gradually increased to cause the density unevenness or the background fogging, thereby degrading the printing quality.

The prior art disclosed in Japanese Unexamined patent publication No. HEI3-155,575 is effective in preventing the hardening of the supply member and a so-called filming phenomenon from occurring. These are caused by the loading of toner into a foam material which is liable to occur when toner of a small particle size is used. However, the prior art has a drawback that the consumption hysteresis remains in the toner layer on the surface of the toner carrier so that, in the succeeding rotation period of the toner carrier, the consumption hysteresis of the previous developing process appears as a ghost.

The prior art disclosed in Japanese Unexmained patent publication No. HEI 4-109,266 has the following drawbacks: In the case where toner of a small size is used, relatively excellent images may be obtained when the number of developing processes remains to be a relatively small value. When a high-density solid image which is continuous in the developing direction is developed after a number of developing processes have been conducted, however, the density of the rear end of the solid image is reduced. The consumption hysteresis remains in the toner layer on the surface of the toner carrier so that, in the succeeding rotation period of the toner carrier, the consumption hysteresis of the previous developing process appears as a ghost.

SUMMARY OF THE INVENTION

The invention has been conducted in order to solve these problems in the prior art. It is an object of the invention to provide a developing device which can stably conduct a soft contact developing process using a soft elastic body. It is another object of the invention to provide a developing device which has a high resolution and is low in density variation. It is a further object of the invention to provide a developing device which can maintain the toner carry amount on the toner carrier at a constant level irrespective of the residue amount of toner and the printing hysteresis, thereby reducing the density unevenness and the printing jitters. It is a still further object of the invention to provide a developing device which can reduce the reduction of density in a solid image and the generation of ghosts, and produce high quality images over a long period.

According to an aspect of the present invention, a developing device of the present invention comprises: a toner carrier for developing a latent image formed on a latent image carrier, the toner carrier opposing the latent image carrier; a supply member which is pressingly contacted with the toner carrier while moving in relative to the toner carrier, thereby supplying toner to the toner carrier, the hardness of the toner carrier being greater than at least that of the supply member; and a regulation member which is slidingly contacted with the toner carrier, thereby thinning toner supplied onto the toner carrier.

In the above configuration of the invention, the supply member supplies toner to the toner carrier while peeling off or uniformalizing the toner layer on the toner carrier. The supply member is opposed to the toner carrier so as to contact with the toner carrier with a predetermined contact pressure, and is rotated in the same direction as the toner carrier (in the opposing area, the moving direction of the supply member is opposite to that of the toner carrier). These manners of arranging and rotating the supply member allow the configuration to be realized in which an uneven toner layer remaining on the toner carrier after the developing process is mechanically peeled off while the toner layer is discharged through the supply member, the peeled toner is again triboelectrically charged together with fresh toner supplied from a toner reservoir so as to be uniformly charged, and thereafter the toner is supplied to the toner carrier. The toner carrier is pressed through press means by the regulation member. In the deformed area of the toner carrier due to the pressing force of the regulation member, toner is triboelectrically charged to a predetermined polarity, and thinned so that one or two toner layers are formed. The thin layered toner is carried to the latent image carrier by rotating the toner carrier, while the thin layer structure of the toner is directly held by the toner carrier. The toner carrier is pressingly contacted with the latent image carrier with a predetermined pressure. In the contacting area or in the vicinity thereof, a developing field is generated by the potential contrast of the latent image carrier and the developing bias applied between the latent image carrier and the toner carrier (or between the latent image carrier and the regulation member) by developing bias apply means, and the latent image is developed by the tenor charged in accordance with the developing field.

DETAILED DESCRIPTION OF THE PREFERRED EMBODIMENTS

Figure 1:
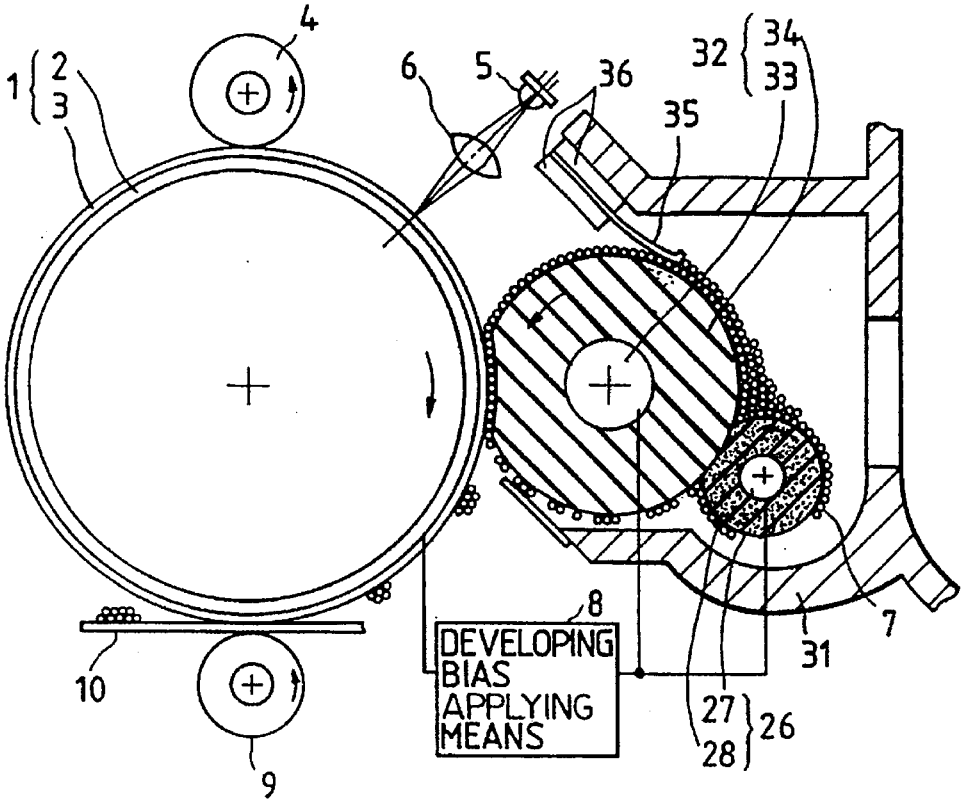
FIG. 1 is a diagram of a developing device which is an embodiment of the invention.

FIG. 1 is a diagram of a developing device which is an embodiment of the invention. A latent image carrier 1 is so constructed that a photosensitive layer 3 made of an organic or inorganic photoconductive material is formed on a conductive supporter 2. The photosensitive layer 3 is charged by a charger 4 such as a charging roller, and then selectively irradiated with a light beam which is emitted from a light source 5 such as a laser device or an LED and transmitted through an imaging optical system 6, in accordance with the image, producing a potential contrast so as to form a desired electrostatical latent image pattern. A developing device 31 carries toner 7 to develop a latent image. More specifically, a toner carrier 32 for carrying the toner 7 is pressed by a blade-like regulation member 35 made of a non-magnetic or magnetic metal or a resin, to elastically deform the regulation member 35. In the contacting area of the toner carrier 32, the toner 7 is triboelectrically charged to a predetermined polarity, and thinned so that the toner layer consists of about one or two toner layers. The toner 7 is directly held on the toner carrier 32, and the toner carrier 32 is rotated so that the thin-layered toner 7 is carried to the latent image carrier 1. A supply member 26 peels off or uniformalizes the toner layer on the toner carrier 32, and supplies the toner 7 to the toner carrier 32. The supply member 26 is opposed to the toner carrier 32 so as to contact with the toner carrier 32 with a predetermined contact pressure, and is rotated in the same direction as the toner carrier 32 (in the contacting area, the moving direction of the supply member 26 is opposite to that of the toner carrier 32). These manners of arranging and rotating the supply member 26 allow the configuration to be realized in which an uneven layer of the toner 7 remaining on the toner carrier 32 after the developing process is mechanically peeled off, the peeled toner is again triboelectrically charged together with fresh toner supplied from a toner reservoir so as to be uniformly charged, and thereafter the toner is supplied to the toner carrier 32. The toner carrier 32 is pressingly contacted with the latent image carrier 1 with a predetermined pressure. In the contacting area or in the vicinity thereof, a developing field is generated by the potential contrast of the latent image carrier 1 and the developing bias applied between the latent image carrier 1 and the toner carrier 32 (or between the latent image carrier 1 and a regulation member 35) by developing bias apply means 8, and the latent image is developed by the toner 7 charged in accordance with the developing field. In this way, the electrostatical latent image pattern on the latent image carrier 1 is developed by the charged toner 7. Then, the image formed by the toner 7 is transferred onto a recording sheet 10 by a transferring device 9 such as a transfer roller, and the toner 7 is fixed to the recording sheet 10 by heat or pressure to form a desired image thereon.

The toner carrier 32 comprises a solid member 34 made of a continuous elastic body such as rubber or elastomer which has a thickness of several millimeter and which is formed on the outer surface of a shaft 33 made of a metal or resin. The surface roughness of the toner carrier 32 in the term of Rz (Mean surface roughness of ten points according to JIS) is several microns. When the toner carrier 32 is formed by a solid member having a hardness of 60 deg. (JIS A hardness) or less, a development nip length of 1 mm or longer can be obtained even in the case of a low developing pressure of 10 gf/mm or less. This allows the stable contacting state between the toner carrier and the latent image carrier to be maintained, and reduces the friction load between the toner carrier and the supply and regulation members, with the result that the rotation irregularity of the toner carrier is reduced so that an image of a reduced printing jitter level is obtained. In the embodiment, the solid member 34 is made of urethane rubber. Alternatively, the solid member 34 may be made of rubber such as natural rubber, silicone rubber, butadiene rubber, chloroprene rubber, neoprene rubber, EPDM, or NBR; or an elastomer containing styrene resin, vinyl chloride resin, polyurethane resin, polyethylene resin, or methacrylic resin. When a flexible layer 25 is formed on the surface of the solid member, the friction load can be reduced, and the charging and carrying of the toner can be stably conducted. Furthermore, when the surface of the solid member is hardened by a heat or chemical treatment, the friction load can be reduced, and a toner carrier having an excellent durability can be formed.

In order to achieve a high-resolution printing according to the development electrode effect, it is preferable that at least the surface of the toner carrier 32 is electrically conductive. The development nip zone constituted by the contacting area between the toner carrier and the latent image carrier has a size of about 1 mm. In order to realize a printing speed up to about 20 PPM, therefore, the tame constant must be sufficiently small so that the developing current can flow during a short developing time. Preferably, the toner carrier has a resistance of $10^9\Omega$ or less.

The regulation member 35 may be a thin plate spring which is made of a metal such as stainless steel or phosphor bronze and has a thickness of several hundreds microns, or may be made of thin resin such as rubber or elastomer. Since the regulation member 35 is thin and liable to be deformed, one end of the regulation member 35 is fixedly sandwiched by fixing plates 36 having a relatively large thickness, and the other end functions as a free end. The toner carrier 32 is pressed by the vicinity of the free front end. When the vicinity of the front end of the regulation member 35 is pressed against the toner carrier 32, the thin toner layer can be formed with a low pressure of several grams per millimeter, so that the generation of the toner filming due to an excessive pressure is suppressed. In order to rectify the toner flow, a bend portion may be formed or a member for rectifying the toner flow may be additionally provided in the vicinity of the front contacting area of the regulation member 35. In this case, the toner peeled from the toner cattier 32 by the regulation member 35 can be stably returned to the supply member 26. Materials useful as that of the regulation member 35 include metals such as steel, stainless steel, brass, and aluminum; a resin such as silicone, and urethane; and a conductive resin obtained by dispersing conductive fine powder of carbon black or the like in such a resin. When, for example, a charge control agent such as a metal complex dye, or a quaternary ammonium salt may be applied to the surface of the regulation member 35, failures in the triboelectric charging such as insufficient or excess charging of the toner layer 7 formed on the toner carrier 32 can be reduced.

The supply member 26 comprises a foamed member 28 which is formed on the outer surface of a shaft 27 made of a metal or resin and which has a predetermined cell density (the foam cell diameter is in the range of several tens to one thousand microns). In the embodiment, the foamed member 28 is made of a conductive foam having a specific resistance of $10^8$ Ωcm or less. The conductive foam is formed by adding a conductive dye such as carbon black or an ionic conductive agent such as a metallic complex salt to the foamed member, or by impregnating the foamed member with a binding agent in which the above-mentioned conductive material is dispersed. In the embodiment, the foamed member 28 is made of a polyurethane foam. Alternatively, the foamed member 28 may be made of another foam such as polystyrene, styrene-acrylonitrile copolymer, ABS, polyethylene, polypropylene, polyvinyl chloride, polyvinyl alcohol, acetylcellulose, polyamide, phenol resin, epoxy resin, urea resin, acrylic resin, EPDM, silicone, polyimide, chloroprene, neoprene, butyl rubber, or SBR. Particularly, as the material of the foamed member 28, it is preferable to use a closed-cell or open-cell flexible foam such as polyethylene, polyurethane, silicone, or neoprene. In order to prevent the loading of toner from occurring and improve the durability, it is preferable to use a closed-cell foam. When the cell density of the surface layer portion of the foamed member 28 is 1 to 20 cells/m, it is convenient to supply the toner 7 to the surface of the toner carrier 32 while holding the toner 7 onto the surface layer portion of the foamed member 28. In this range, the toner can be efficiently supplied to the surface of the toner carrier 32 without being affected by the variation in particle size and flowability of the toner 7. In a foamed member having a cell density which is smaller than 1 cell/mm or greater than 20 cells/m, however, it is difficult in fact to sufficiently hold the toner onto the surface layer portion of the foamed member, so that the rotation of the supply member causes the toner to pass through or falling off the surface layer portion of the foamed member. This causes a failure in supply of toner to the toner carrier, with the result that there arises irregular or insufficient carrying in the toner layer on the surface of the toner carrier. The cell density of the foamed member 28 is obtained by producing a magnified image of the surface layer portion of the foamed member using a laser microscope (manufactured by LASER TEK), segmenting the magnified image into cell-formation regions due to foaming and solid regions where there is no foaming, on the basis of a displacement curve and magnified image which are obtained by laser-scanning the irregular surface layer, and calculating the number of cells in a unit length of an arbitrary line. When the supply member 26 is rotatably disposed in such a manner that it contacts with the toner carrier 32 with a contact pressure of 2 to 20 gf/mm, it is convenient to form a new toner layer on the surface of the toner carrier 32 at the same time when an uneven toner layer remaining on the surface as the consumption hysteresis is peeled off after the developing process. The formation of the toner layer is conducted by holding the toner which has been sandwiched between the surface of the toner carrier and the surface layer portion of supply member to be triboelectrically charged, onto the surface of the toner carrier. When the supply member 26 is contacted with the toner carrier with a contact pressure less than 2 gf/mm, there is a disadvantage that an uneven toner layer remaining on the toner carrier after the developing process cannot be peeled off, resulting in that the consumption hysteresis of the toner appears as a ghost in the succeeding developing periods. When the supply member 26 is disposed with a contact pressure greater than 20 gf/mm, the driving torque for the developing device is increased and the toner sandwiched between the supply member and the toner carrier aggregates, with the result that the image quality is impaired. Therefore, in the configuration where a supply member constructed by a foamed member having a predetermined cell density is disposed so as to contact with the toner carrier with a predetermined contact pressure, even when a high-density solid image continuous in the developing direction is developed, the density of the rear end of the solid image is not reduced so that high-quality images without a ghost can be obtained over a long period. When the permanent compression set of the foamed member 28 constituting the supply member 26 is 30% or less, preferably 20% or less, the contact pressure of the supply member 26 against the toner carrier 32 prevented from fluctuating, thereby allowing the supply and peeling of the toner 7 with respect to the toner carrier 32 to be stably conducted. If the permanent compression set of the foamed member 28 of the supply member is greater than 30%, in the case where the developing device 31 having the supply member 26 contacting with the toner carrier 32 or an auxiliary charging member 44 is allowed to stand for a long period, the portion of the supply member 26 which contacts with the toner carrier 32 or the auxiliary charging member 44 is permanently deformed. If the supply member 26 has a portion which is permanently deformed in a degree higher than a predetermined one, the permanently deformed portion of the supply member 26 cannot apply a necessary contact pressure to the toner carrier 32 immediately after the start of the operation of the developing device 31. This insufficient contact pressure causes failures in the peeling of the toner which remains on the surface of the toner carrier 32 as the consumption hysteresis after the developing process, and in the formation of a new toner layer. These appear in the image developing process as the reduced density of a solid image and a ghost. In contrast, if the permanent compression set of the foamed member 28 constituting the supply member 26 is 30% or less, the permanent deformation of the supply member is small in degree so that the peeling and supply of the toner with respect to the toner carrier 32 are sufficiently conducted and high-quality images without reduction of density and a ghost can be obtained.

The application of a developing bias voltage to at least two of the toner carrier 32, the supply member 26 and the regulation member 35 allows the charges of the reversed polarity which are generated by the triboelectric charging between these members and the toner 7, to be discharged to the power source or the like, so that the fluctuation of density due to the accumulation of unnecessary charges is prevented from occurring, whereby the stable developing state can be maintained. In order to prevent the formation of a fixed layer due to the adhesion of the toner 7 from occurring, the developing bias voltage is preferably applied to members which are not insulative.

The photosensitive layer 3 of the latent image carrier 1 may be made of an organic or inorganic photoconductive material. Arrows in the figures indicate the rotation direction of the respective member. Preferably, the ratio of the peripheral velocity of the latent image carrier to that the toner carrier is in the range of 1:1 to 1:5. The invention is not restricted to these figures and values. Although the invention is preferably applied to a developing device for the pressure developing process, the invention may be applied to a developing device for the contact or non-contact developing process in which a thin toner layer must be formed.

The toner 7 may be either of magnetic toner and non-magnetic toner. In the case where the toner 7 is magnetic toner, when the supply member 26 is formed by a magnet, the toner supplying amount can be stabilized. Alternatively, the toner 7 may be either of resin toner and wax toner. The toner 7 may include an additive such as colloidal silica, and is not restricted to one-component toner. When one-component toner is used, the volume average particle diameter is preferably within the range of 3 to 15 μm.

Figure 2:
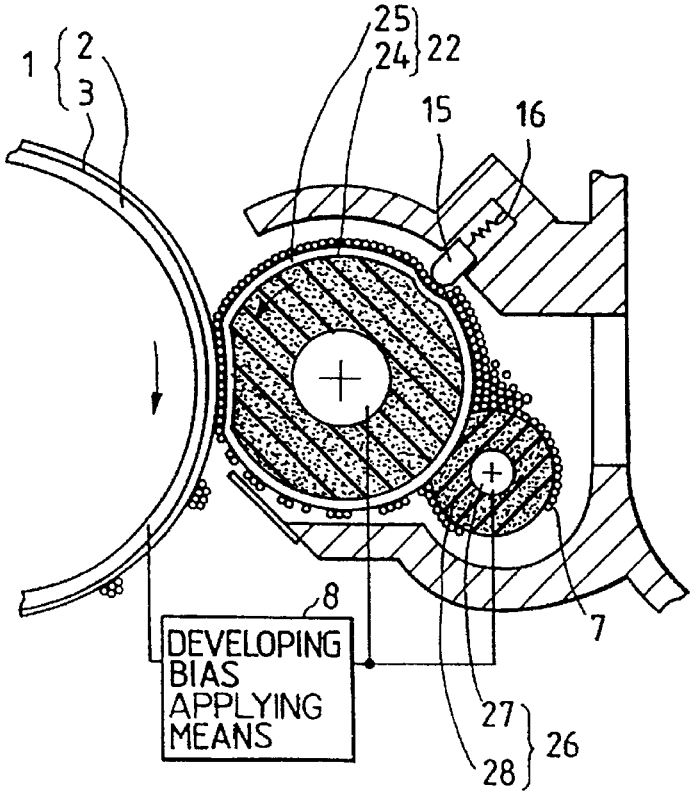
FIG. 2 is a diagram of a developing device which is another embodiment of the invention.
Figure 3A:
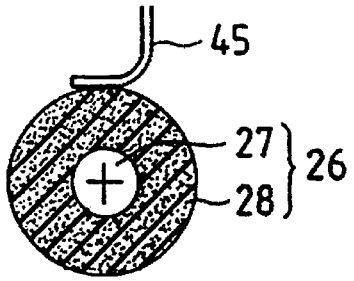
FIGS. 3A to 3D are diagrams showing the disposition of an auxiliary charging member which is used in an embodiment of the invention.
Figure 3B:
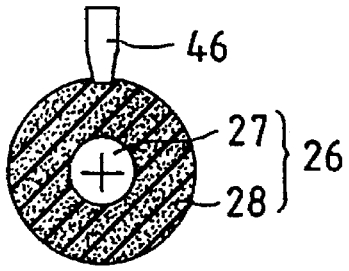
Figure 3C:
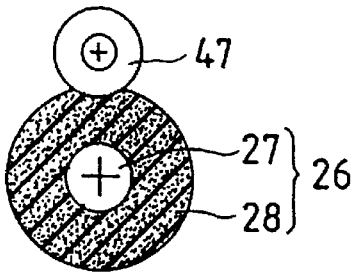
Figure 3D:
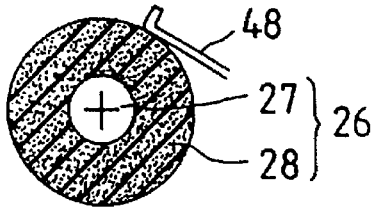

FIG. 2 is a diagram showing another toner carrier 22. A foamed member 24 having foam cells of several tens to one thousand microns is formed on the outer surface of a shaft 23 made of a metal or a resin. A flexible layer 25 having a thickness of several tens to several hundreds microns is formed on the outer surface of the foamed member 24. The configuration in which the toner carrier 22 is constructed by the formed member 24 and the thin flexible layer 25 having a surface of a low expansivity so as to attain the rubber hardness of 40 deg. (JIS A) or less can reduce the friction load between the foamed member 24 and the foamed member constituting the supply member 26. Moreover, the configuration enables the development nip length to be 1 mm or longer even in the case of a low developing pressure of 5 gf/mm or less, thereby allowing the soft pressure developing process to be stably conducted. In the embodiment, the foamed member 24 is made of a polyurethane foam. Alternatively, the foamed member 24 may be made of another foam in the same manner as the foamed member 28 constituting the above-mentioned supply member 26. Particularly, flexible foams such as polyethylene, polyurethane, silicone, and neoprene are suitable as the material of the foamed member 24. Among these materials, a polyurethane foam is excellent in moldability and has a high hydrophilic property, and therefore it is suitable for forming a flexible layer such as a conductive layer or a magnetic-field generating layer on the surface. The flexible layer 25 may have a single-layer structure or a multi-layer structure. When the flexible layer 25 is formed by a conductive layer, the development electrode effect allows a high-resolution printing to be achieved. When the flexible layer 25 is formed by a ferromagnetic layer, the carrying can be conducted on the basis of a magnetic force of magnetic toner. When the flexible layer 25 is formed by an abrasion-resistant layer, it is possible to protect the surface so me to improve the durability. When the flexible layer 25 is formed by a charging layer, toner can be rapidly charged to a predetermined charge level so that the triboelectrification of the toner is improved. In the embodiment, the flexible layer 25 is formed by a conductive heat-shrinkable layer in which carbon black is dispersed in a main binder of polyurethane. Examples of materials useful as the main binder include fluororesin, polyethylene, polyimide, polyester, polystyrene, polypropylene, polybutadiene, acrylic resin, PVA, silicone, and polyamide. Examples of materials useful as the conductive material include graphite, metal powder, a metallic complex salt, and a metallic oxide. Examples of materials useful as the ferromagnetic material, useful are magnetite, ferrite, γ-hematite, iron, nickel, cobalt, an iron-nickel alloy, an iron-cobalt alloy, and a nickel-cobalt alloy. Examples of materials useful as the abrasion-resistant material include graphite, molybdenum disulfide, and boron nitride. Examples of materials useful as the charge control agent include a metallic complex salt, and a quaternary ammonium salt.

FIG. 3 is a diagram of an auxiliary charging member which is disposed so as to slidingly contact with the supply member 26 through the toner 7. The auxiliary charging member is made of a material which has a polarity reversed to the triboelectric polarity of the toner 7 in the triboelectric series. The auxiliary charging member is disposed so as to contact with the supply member 26 through the toner 7, and the toner 7 held on the supply member 26 is previously triboelectrically charged to a predetermined polarity, thereby facilitating the formation of a toner layer on the toner carrier 32. FIG. 3(*a*) shows a blade-like flexible auxiliary charging member 45 which is disposed on the supply member and made of a rubber plate, an elastomer plate, a resin thin plate, or a metal thin plate. FIG. 3(*b*) shows a rigid blade-like auxiliary charging member 46 which is disposed on the supply member and made of a resin plate, a metal plate, or a ceramic plate. FIG. 3(*c*) shows an auxiliary charging member 47 which is disposed on the supply member and has a form of a rubber elastic roller, an elastomer elastic roller, a resin rigid roller, a metal rigid roller, or a ceramic rigid roller. FIG. 3(*d*) shows a blade-like elastic auxiliary charging member 48 which is formed by bending one end of a rubber plate, an elastomer plate, a resin thin plate, or a metal thin plate into an L-like shape and is disposed so that the vicinity of the end pressingly contacts with the supply member. Preferably, the auxiliary charging member contacts with the supply member 26 with a contact pressure of about 0.5 to 10 gf/mm. Materials useful as the auxiliary charging member are those in which at least the surface portion contacting with the supply member 26 exists at a polarity reversed to the triboelectric polarity of the toner 7 in the triboelectric series. When the triboelectric polarity of the toner 7 is positive, for example, organic materials such as fluororesin, polyethylene, epoxy resin, urea resin, polyimide, polyester, polystyrene, polypropylene, polybutadiene, and SBR; and metallic complex salt dyes such as Cr complex salt, Zn complex salt, Fe complex salt, and Al complex salt can be used singly or mixedly. When the triboelectric polarity of the toner 7 is negative, organic materials such as polyamide, melamine resin, acrylic resin, PVA, polyurethane, and silicone; quaternary ammonium salt; and nigrosine dye can be used singly or mixedly. Furthermore, metallic materials such as Ti, Sn, Fe, On, Or, Mi, Zn, Mg, and Al; and inorganic materials such as $TiO_2$, $SnO_3$, $Fe_2O_3$, $Fe_3O_4$, CuO, $Cr_2O_3$, NiO, ZnO, MgO, and $Al_2O_3$ can be used singly or mixedly in either of the case where the triboelectric polarity of the toner 7 is positive and the case where it is negative. It is needless to say that the above-mentioned organic materials, metallic materials, inorganic materials, etc. can be adequately combined so as to be suitable for the triboelectric polarity of the toner 7. The triboelectric series of the material for the auxiliary charging member can be obtained as follows. The polarities of the surface potentials generated when arbitrarily selected two kinds of materials are subjected to the contact charging in an electrically shielded space are to checked by a surface electrometer, and the thus obtained relationships between positive and negative polarities of materials are ranked. When the polarity of the toner 7 is positive, it is preferable to form the auxiliary charging member with a material which is at a position of the negative polarity side with respect to and largely separated from the toner 7 in the triboelectric series. In contrast, when the polarity of the toner 7 is negative, it is preferable to form the auxiliary charging member with a material which is at a position of the positive polarity side with respect to and largely separated from the toner 7. The auxiliary charging member may be electrically conductive, and set to be the same potential as that of the supply member 26. Alternatively, there may be a potential difference between the auxiliary charging member and the supply member 26.

Figure 4:
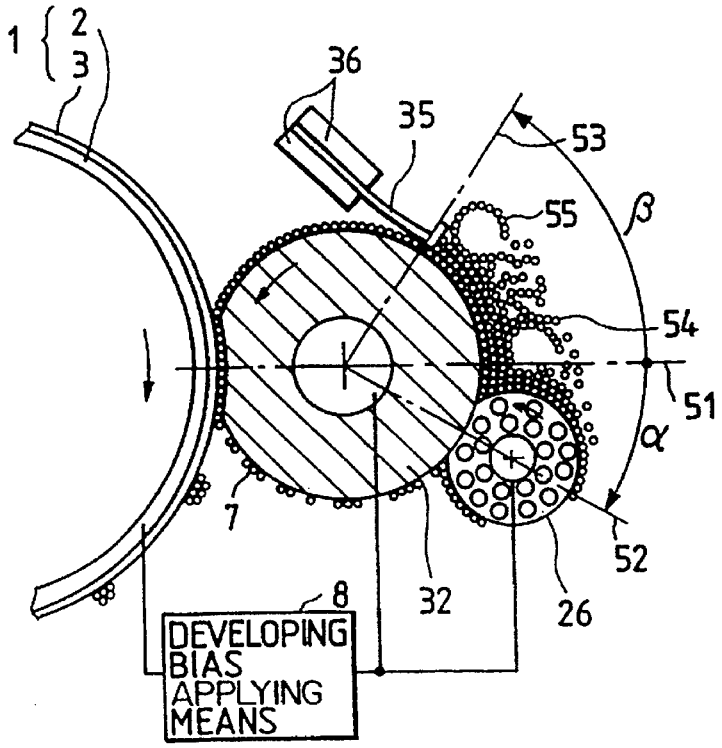
FIG. 4 is a diagram of a developing device which is a further embodiment of the invention.

In FIG. 4, the supply member 26 is located below a horizontal line 51 passing through the center of the toner carrier 32 in such a manner that a line 52 connecting the center of the toner carrier 32 and the center of the supply member 26 forms an angle α with respect to the horizontal line 51. The regulation member 35 is located above the horizontal line 51 in such a manner that a line connecting the center of the toner carrier 32 and the contact area of the regulation member 35 forms an angle β with respect to the horizontal line 51. The supply member 26 mechanically peels off an uneven layer of the toner 7 remaining on the toner carrier 32 after the developing process, while discharging the toner through the supply member 26. The supply member 26 conducts the triboelectric charging on the peeled toner and fresh toner supplied from a toner reservoir so as to be uniformly charged, and thereafter supplies the toner to the toner carrier 32. In the portion above the wedge-like area formed by the toner carrier 32 and the supply member 26, the toner 7 supplied by the supply member 26 causes a swirl flow of toner to be formed as indicated by arrow 54. This swirl flow is affected by the toner amount on the supply member 26 so that it tends to become an unsteady flow. Preferably, therefore, the regulation member 35 and the toner carrier 32 contact with each other at a position where is separated from the supply member 26 and the toner is hardly affected by the swirl flow. The toner on the toner carrier 32 is thinned by passing the regulation member 35 so that the thickness of the toner is reduced in the range of several tenths to several hundredths. The regulation of the toner by the regulation member 35 affects the toner flow so that a swirl flow of toner is formed as indicated by arrow 55. When the regulation member 35 and the supply member 26 are located in such a manner that they form a central angle of 45 to 90 degree. with respect to the center of the toner carrier 32, the regulated toner can be returned onto the supply member 26 so that the stable supply and regulation can be maintained. This arrangement of the members reduces the mutual effect of the two swirl flows of toner indicated by arrows 54 and 55. The configuration in which the flows of toner are considered can stably conduct the thinning operation on the toner.

Figure 5:
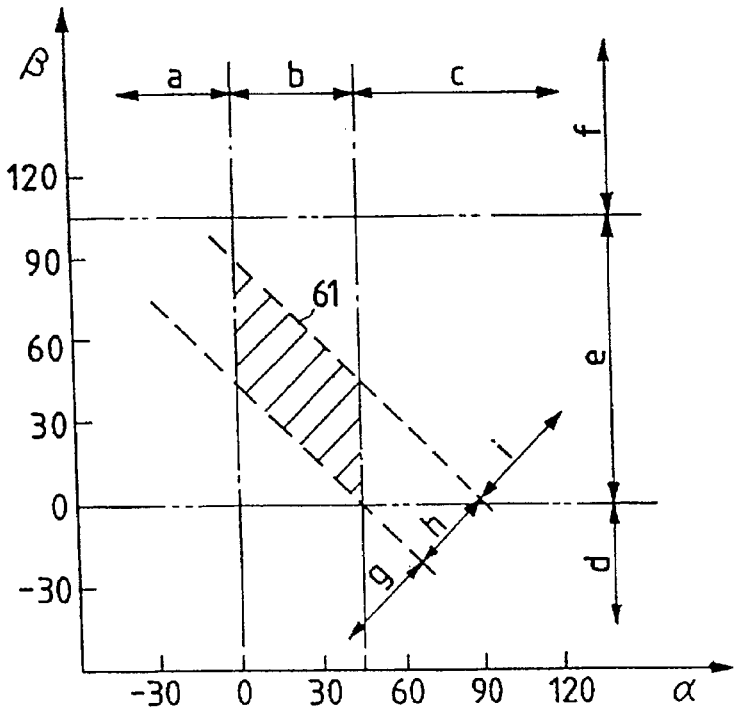
FIG. 5 is a graph showing the toner supply property and the toner thinning and regulating property of a developing device according to the invention.

FIG. 5 shows the toner supply property and the toner thinning and regulating property of the developing device of FIG. 4 in which the angles α and β are used as parameters. Hereinafter, the description will be made with reference to FIG. 5 showing an example in which the outer diameter of the toner carrier 32 is 20 mm, the outer diameter of the supply member 26 is 12.5 mm, and the center distance between the toner carrier 32 and the supply member 26 is 16 mm.

In a region a where the angle α defined by the horizontal line 51 and the line connecting the center of the toner carrier 32 and the center of the supply member 26 is not greater than 0 deg. ($\alpha<0$ deg.), a wedge-shaped bank of toner is formed in the vicinity of the contacting area of the toner carrier 32 and the supply member 26. This causes the toner supply amount to be gradually reduced as the printing number increases, thereby reducing the density of printed images. In a region c where the angle α is not smaller than 45 deg. ($\alpha>45$ deg.), a sufficient amount of the toner cannot be held on the supply member 26, and the reduced amount of the toner on the supply member 26 causes the density of printed images to be reduced. In a region b where the angle α is between 0 degree and 45 degree. (0 degree$\leqq\alpha\leqq$45 degree.), a sufficient amount of the toner is held on the supply member 26 so that the toner is sufficiently supplied, and a wedge-shaped bank of toner is not formed in the vicinity of the contacting area of the toner carrier 32 and the supply member 26. Therefore, it is preferable to set the angle α to be about 0 to 45 degree., and more preferably about 30 degree.

In a region d where the angle β formed by the horizontal line 51 and the line connecting the center of the toner carrier 32 and the contacting area of the regulation member 35 is not greater than 0 degree. ($\alpha<0$ degree.), a bank of toner is formed in the vicinity of the front end of the regulation member 35. Accordingly, depending on the storage amount of the toner, there arises an excess pressure at the front end of the regulation member 35 so that the toner carrying is impeded or the members such as the toner carrier 32 are damaged. Moreover, since the existence of a bank of toner exists in the vicinity of the front end of the regulation member 35, a fixed layer of toner is easily formed in the vicinity of the front end of the regulation member 35. This fixed layer of toner causes the toner to form a layer of an uneven thickness and produces a sone where no toner exists so as to produce images of uneven density. In a region f where the angle $\beta$ is not smaller than 105 degree. ($\alpha>105$ degree.), toner in the vicinity of the front end of the regulation member 35 fails to be returned so as to form a bank of toner, and a fixed layer of toner is easily formed in the vicinity of the front end of the regulation member 35. Moreover, there arises an excess pressure at the front end of the regulation member 35 so that the toner cannot be sufficiently thinned, resulting in that low-charged toner or reversely-charged toner adheres to a nonimage area (background fogging). Moreover, the charge level of the toner is gradually lowered as the printing number increases, whereby the amount of toner used in the developing is increased. In a region e where the angle $\beta$ is between 0 degree and 105 degree. ($0\leqq\beta\leqq105$ degree.), a bank of toner is hardly formed in the vicinity of the front end of the regulation member 35. Therefore, the toner regulated by the regulation member 35 can be returned to the supply member 26 so that the toner circulation and the formation of the thin toner layer are stably conducted. Therefore, it is preferable to set the angle $\beta$ to be about 0 to 105 deg., and more preferably about 45 deg.

In a region g where the angle $\alpha+\beta$ from the contacting position of the toner carrier 32 and the supply member 26 to the contacting position of the toner carrier 32 and the regulation member 35 with respect to the center of the toner carrier 32 is not greater than 45 deg. ($\alpha+\beta<45$ deg.), the swirl flow of toner produced by the supply member 26 causes the toner to form a layer of an uneven thickness and to adhere to the regulation member 35, so that the unevenness of the density is gradually increased as the printing number increases. In a region h where the angle $\alpha+\beta$ is not smaller than 90 deg.($\alpha+\beta>90$ degree), the operation of thinning the toner can be conducted in an approximately stable manner, but it is difficult to return the toner regulated by the regulation member 35 to the supply member 26, resulting in that a bank of toner is possibly formed. In order to maintain a stable density of printed images, therefore, another member must be additionally disposed so that the circulation of the toner is stabilized. In a region i where the angle $\alpha+\beta$ is between 45 degree. and 90 degree. (45 degree$\leqq\alpha+\beta\leqq$90 degree.), it is not necessary to add another member, the toner is stably supplied to the toner carrier 32, the toner is stably thinned to one or two toner layers by the regulation member 35, and the regulated toner is returned to the supply member 26 so that the toner circulation is stably conducted and images of reduced density unevenness are continuously formed. Therefore, it is preferable to set the angle $\alpha+\beta$ to be about 45 to 90 degree., and more preferably about 70 degree.

In a hatched area 61 of FIG. 5 obtained by combining the above-mentioned angle ranges, the toner can be stably supplied to the toner carrier, the regulation for thinning the toner on the toner carrier which has completed the toner supply carrier can be stably conducted, and the toner can be stably circulated in the developing device. Therefore, high resolution images with reduced density variation can be formed over a long period.

When the cell density of the surface layer portion of the supply member 26 is d cells/mm, the peripheral velocity of the toner carrier 32 is $V_1$ mm/sec, the peripheral velocity of the supply member 26 is $V_2$ mm/sec, and the contact pressure between the carrier and the member is f gf/mm, the disposition conditions of the toner carrier 32 and the supply member 26 satisfies the relationship of $$10\leqq d*f*(V_1+V_2)/V_1\leqq200$$

In this configuration, an uneven layer of the toner 7 remaining as the consumption hysteresis on the surface of the toner carrier 32 after the developing process is mechanically peeled off while discharging the toner through the supply member 26, the peeled toner is again subjected to the triboelectric charging together with fresh toner supplied from a toner reservoir so as to be uniformly charged, and the charged toner is then supplied to the toner carrier 32, thereby forming a uniform toner layer adhering to the surface of the toner carrier. Particularly, when toner which remains in a toner container after repeating the developing many times and which is inferior in flowability and triboelectric charging ability is to be efficiently formed into a layer on the toner carrier, the relationship between the cell density d of the surface layer portion of the supply member and the contact pressure f between the toner carrier and the supply member plays an important role. The capacity of a supply member rotating at a peripheral velocity $V_2$ for supplying toner to a toner carrier rotating at a peripheral velocity $V_1$ can be expressed as $d*(V_1+V_2)/V_1$. The capacity for holding fresh toner onto the toner carrier to form a layer can be expressed by multiplying the contact pressure f and the expression, or by $f*d*(V_1+V_2)/V_1$. The contact pressure f contributes to the efficiency of peeling off toner remaining on the surface of the toner carrier, and to the efficiency of forming a toner layer adhering to the toner carrier by triboelectrically charging the toner. In order to continue over a long period the formation a uniform toner layer adhering to the surface of the toner carrier using toner which is inferior in flowability and triboelectric charging ability, the developing device must be so configured that the above-mentioned peeling and layer formation efficiencies are rationalized. The studies conducted by the inventors revealed that, under the condition of $d*f*(V_1+V_2)/V_1<10$, the formation of a toner layer adhering to the surface of a toner carrier becomes imperfect as the toner deteriorates, and that an uneven layer of the toner 7 remaining as the consumption hysteresis cannot be peeled off, thereby reducing the density of the rear end of a solid image and forming a ghost. In a developing device in which the condition of $d*f*(V_1+V_2)/V_1>200$ is satisfied, since the driving torque is increased and the rotational velocity is fluctuated, images having many jitters are produced, toner is aggregated, and the supply member is deteriorated. Moreover, it was revealed that, when the developing process is repeated, sunspot-like stains of the background and voids due to coarse aggregated powder are formed. Therefore, in a developing device in which the relational expression of $$10\leqq d*f*(V_1+V_2)/V_1\leqq200$$

is satisfied, even when a high-density solid image continuous in the developing direction is developed, the density of the rear end of the solid image is not reduced so that high-quality images without a ghost can be obtained with an excellent reproducibility over a long period.

Figure 6:
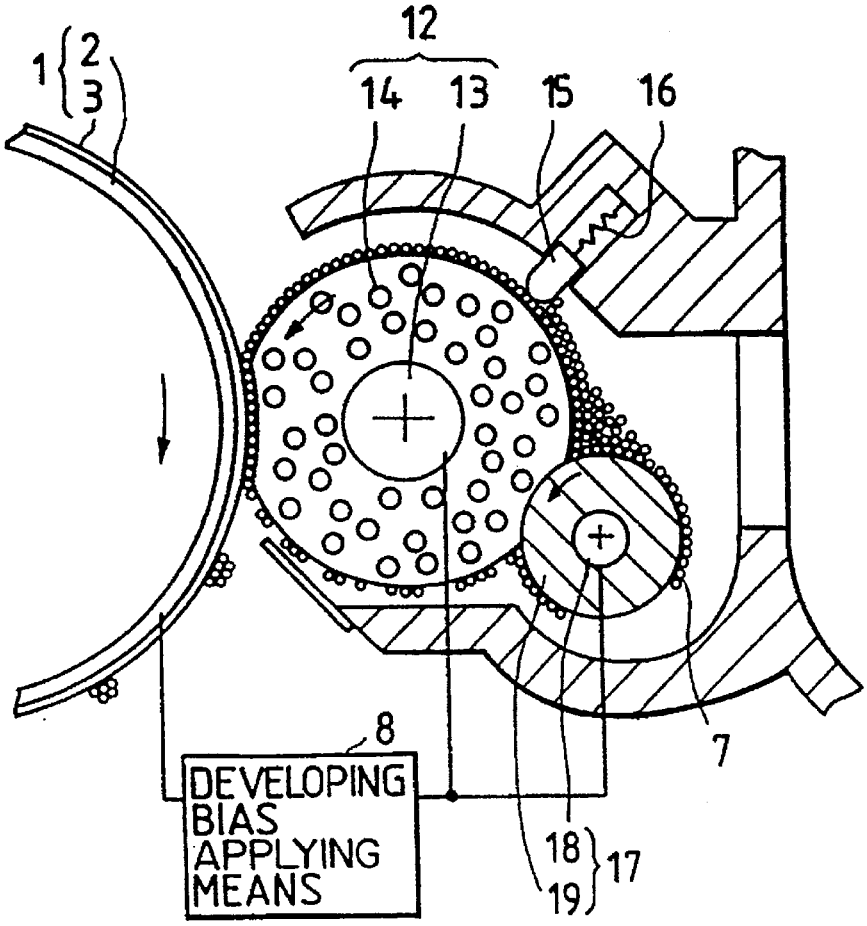
FIG. 6 is a diagram of a developing device which is a still further embodiment of the invention.

FIG. 6 is a diagram of a developing device which is another embodiment of the invention. A blade-like or cylindrical regulation member 15 made of a non-magnetic or magnetic metal or a resin is urged by press means 16 using an elastic body such as a spring or rubber, against a toner carrier 12 for carrying toner 7. This causes the regulation member 15 to be elastically deformed so that, at the contacting area of the toner carrier 12, the toner 7 is triboelectrically charged to have a predetermined polarity, and thinned so that one or two toner layers are formed. At least the surface of the toner carrier 12 is formed by a foamed member having a hardness of 40 degree. (JIS A) or less. When pressed by a rigid body, the toner carrier 12 is easily deformed. Similarly, when the toner carrier 12 is formed by a foamed member having a hardness of 40 degree. (JIS A) or less, a development nip length of 1 mm or longer can be obtained even in the case of a low developing pressure of 5 gf/mm or less, thereby allowing the soft contact developing process to be stably conducted. The toner carrier 12 comprises a foamed member 14 which is formed on the outer surface of a shaft 13 made of a metal or resin and which has foam cells of several tens to one thousand microns. In the embodiment, the foamed member 14 is formed by a polyurethane foam. Alternatively, the foamed member 14 may be made of another foam in the same manner as the foamed member 28 of the supply member 26 described above. A supply member 17 comprises a cylindrical solid member 19 made of a metal, resin or hard rubber and formed on the outer surface of a shaft 18 made of a metal or resin. The surface roughness of the supply member 17 is several tens microns.

Figure 7:
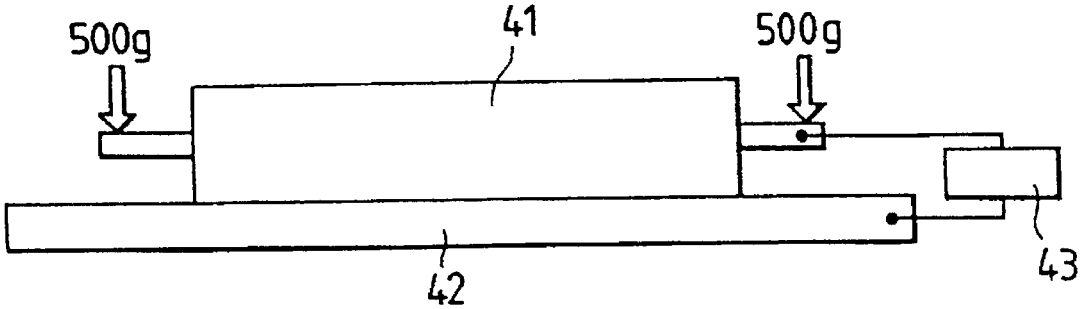
FIG. 7 is a diagram showing a method of measuring the resistance of a toner carrier used in a developing device according to the invention.

FIG. 7 is a diagram showing a method of measuring the resistance of a toner carrier used in the developing device of the invention. A load of 500 gf is applied to each of she shafts at the both ends of a toner carrier 41 so that the toner carrier 41 is urged against a conductive plate 42. Under this state, an ohmmeter 43 is connected between one of the shafts of the toner carrier 41 and the conductive plate 42 to measure the resistance. According to this resistance measuring method, the resistance in the nip condition of the toner carrier and a latent image carrier can be estimated. When a developing current in the order of several microamperes, which is a developing current for the black solid image printing, is to be obtained, the toner carrier has preferably a resistance of $10^9\Omega$ or less. However, the resistance is not restricted to this value because, when a high-resistance or insulative toner carrier having a resistance higher than this value is used, the provision of a discharging mechanism in the toner carrier allows the printing to be continued.

Hereinafter, embodiments will be described in more detail.

First Embodiment

The developing device and image forming apparatus shown in FIG. 1 were constructed using a toner carrier, a supply member and a regulation member listed in (1) to (3) below. Image forming operations were conducted while using one-component non-magnetic toner of a volume average particle diameter of 9 μm, and applying a developing bias voltage to the toner carrier, the supply member and the regulation member.

(1) Toner carrier

A conductive urethane rubber layer was formed on a shaft made of stainless steel. The outer surface of the rubber layer was polished. Thereafter, only the outer surface layer was subjected to a hardening process using heat or light to obtain a toner carrier in which the surface roughness in the term of Rz was 5 μm, the rubber hardness (JIS A) was 50 degree., the outer diameter was 20 mm, the thickness of the rubber layer was 6 mm, and the resistance according to the resistance measuring method of FIG. 7 was $10^7\Omega$.

(2) Supply member

An open-cell polyurethane foam layer was formed on a shaft made of stainless steel as a foamed member having the cell density d of 5 cells/mm (the average foam cell diameter was about 200 μm), thereby forming a supply member in which the rubber hardness (JIS A) was 30 degree., the outer diameter was 12.5 mm, and the thickness of the foam layer was 3.25 mm. The supply member was pressingly contacted with the toner carrier in such a manner that the center distance between the toner carrier and the supply member was 16 mm.

(3) Regulation member

The front end of a plate spring made of stainless steel and having a thickness of 0.1 mm was bent into an L-like shape. The vicinity of the front end of the regulation member was pressingly contacted with the toner carrier with a contact pressure of 5 gf/mm.

Using the thus configured developing device, a pattern including a gray-scale image of a resolution of 300 DPI, a line image, a solid image and a character image was continuously formed on 5,000 sheets. Dot images of 300 DPI and line images were stably formed without increasing the width of a line, and high resolution images excellent in area gray-scale were formed. Furthermore, clear character images without background fogging were formed, and high-density solid images of an OD value of 1.4 or more and without uneven density were stably formed. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. No damage of the toner was observed.

As a comparison, the image formation was conducted under the same conditions except that another developing device configured in the following manner was used. A conductive urethane rubber layer was formed on a shaft made of stainless steel. The outer surface of the rubber layer was polished. Thereafter, only the outer surface layer was subjected to a hardening process using heat or light to obtain a toner carrier in which the surface roughness in the term of Rz was 5 μm, the rubber hardness (JIS A) was 70 degree., the outer diameter was 20 mm, the thickness of the rubber layer was 6 mm, and the resistance was $10^7\Omega$. An open-cell polyurethane foam layer was formed on a shaft made of stainless steel as a foamed member having the cell density d of 5 cells/mm (the average foam cell diameter was about 200 μm), thereby forming a supply member in which the rubber hardness (JIS A) was 30 deg., the outer diameter was 12.5 mm, and the thickness of the foam layer was 3.25 mm. The supply member was pressingly contacted with the toner carrier. A regulation member in which the front end of a plate spring made of stainless steel and having a thickness of 0.1 mm was bent into an L-like shape was pressingly contacted with the toner carrier with a contact pressure of 5 gf/mm. As a result, a thin toner layer was stably formed on the toner carrier. However, the state where the latent image carrier pressingly contacts with the toner carrier in a soft manner was not obtained. The density unevenness was produced in the right and left ends of images. All images were blurred, and many voids were produced in solid images. After the printing test, it was observed that many streaks were formed on the surfaces of the latent image carrier and the toner carrier.

The image formation was conducted under the same conditions except that a further developing device configured in the following manner was used. A conductive urethane rubber layer was formed on a shaft made of stainless steel. The outer surface of the rubber layer was polished. Thereafter, only the outer surface layer was subjected to a hardening process using heat or light to obtain a toner carrier in which the surface roughness in the term of Rz was 5 μm, the rubber hardness (JIS A) was 50 degree., the outer diameter was 20 mm, the thickness of the rubber layer was 6 mm, and the resistance was $10^7\Omega$. An aluminum cylinder was subjected to the sand blasting to form a supply member in which the surface roughness in the term of Rz was 20 μm, and the outer diameter was 12.5 mm. The supply member was pressingly contacted with the toner carrier. A regulation member which is a plate made of stainless steel and having a thickness of 3 mm was chamfered at its front end, and pressingly contacted with the toner carrier with a contact pressure of 5 gf/mm. As a result, the driving torques of the toner carrier and the supply member were extremely increased, and the variation of the rotational velocity was produced. It was observed with the naked eye that there were printing jitters which are traversal lines caused by sharp density unevenness. All images were blurred, and many voids were produced in solid images. After the printing tests, it was observed that many streaks were formed on the surfaces of the latent image carrier and the toner carrier.

Second Embodiment

Under the same conditions as the first embodiment, the image formation was conducted in the following manner. A conductive urethane rubber layer was formed on a shaft made of stainless steel. The outer surface of the rubber layer was polished. Thereafter, only the outer surface layer was subjected to a hardening process using heat or light to obtain a toner carrier in which the surface roughness in the term of Rz was 5 μm, the rubber hardness (JIS A) was 50 deg., the outer diameter was 20 mm, the thickness of the rubber layer was 6 mm, and the resistance according to the resistance measuring method of FIG. 7 was $10^7\Omega$. An open-cell polyurethane foam layer was formed on a shaft made of stainless steel as a foamed member having the cell density d of 5 cells/mm (the average foam cell diameter was about 200 μm), thereby forming a supply member in which the rubber hardness (JIS A) was 30 deg., the outer diameter was 12.5 mm, and the thickness of the foam layer was 3.25 mm. The supply member was pressingly contacted with the toner carrier in such a manner that the center distance between the toner carrier and the supply member was 16 mm. A regulation member was used in which a flexible plate made of urethane rubber and having a thickness of 1.5 mm was fixed to a metal plate. The vicinity of the front end of the regulation member was pressingly contacted with the toner carrier with a contact pressure of 5 gf/mm. As a result, dot images of 300 DPI and line images were stably formed without increasing the width of a lane, and high-resolution images excellent in area gray-scale were formed. Furthermore, clear character images without background fogging were formed, and high-density solid images of an OD value of 1.4 or more and without uneven density were stably formed. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. No damage of the toner was observed.

Third Embodiment

Under the same conditions as the first embodiment, the image formation was conducted in the following manner. A conductive silicone rubber layer was formed on a shaft made of stainless steel. The outer surface of the rubber layer was polished. Thereafter, annealing was conducted so as to scatter a plasticizer and silicone oligomer, thereby obtaining a toner carrier in which the surface roughness in the term of Rz was 9 μm, the rubber hardness (JIS A) was 45 deg., the outer diameter was 20 mm, the thickness of the rubber layer was 6 mm, and the resistance was according to the resistance measuring method of FIG. 7 was $10^4\Omega$. An open-cell polyurethane foam layer was formed on a shaft made of stainless steel as a foamed member having the cell density d of 5 cells/mm (the average foam cell diameter was about 200 m), thereby forming a supply member in which the rubber hardness (JIS A) was 30 deg., the outer diameter was 12.5 mm, and the thickness of the foam layer was 3.25 mm. The supply member was pressingly contacted with the toner carrier in such a manner that the center distance between the toner carrier and the supply member was 16 mm. A regulation member was used in which a flexible plate made of urethane rubber and having a thickness of 1.5 mm was fixed to a metal plate. The vicinity of the front end of the regulation member was pressingly contacted with the toner carrier with a contact pressure of 5 gf/mm. As a result, dot images of 300 DPI and line images were stably formed without increasing the width of a line, and high-resolution images excellent in area gray-scale were formed. Furthermore, clear character images without background fogging were formed, and high-density solid images of an OD value of 1.4 or more and without uneven density were stably formed. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. No damage of the toner was observed. Although the surface of the toner carrier was worn away by 10 to 20 μm, no influence of this wear on images was observed.

Fourth Embodiment

Under the same conditions as the first embodiment, the image formation was conducted in the following manner. A conductive urethane rubber layer was integrally formed on a shaft made of stainless steel. A conductive urethane coating material containing fine metal powder as the main component was applied in a thickness of about 20 μm to the outer surface of the rubber layer to obtain a toner carrier in which the surface roughness in the term of Rz was 5 μm, the rubber hardness (JIS A) was 50 deg., the outer diameter was 20 mm, the thickness of the rubber layer was 6 mm, and the resistance according to the resistance measuring method of FIG. 7 was $10^7\Omega$. An open-cell silicone foam layer was formed on a shaft made of stainless steel as a foamed member having the cell density d of 5 cells/mm (the average foam cell diameter was about 200 μm), thereby forming a supply member in which the rubber hardness (JIS A) was 28 deg., the outer diameter was 12.5 mm, and the thickness of the foam layer was 3.25 mm. The supply member was pressingly contacted with the toner carrier in such a manner that the center distance between the toner carrier and the supply member was 16 mm. A regulation member in which the front end of a plate spring made of stainless steel and having a thickness of 0.1 mm was bent into an L-like shape was pressingly contacted with the toner carrier with a contact pressure of 5 gf/mm. As a result, dot images of 300 DPI and line images were stably formed without increasing the width of a line, and high-resolution images excellent in area gray-scale were formed. Furthermore, clear character images without background fogging were formed, and high-density solid images of an OD value of 1.4 or more and without uneven density were stably formed. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. No damage of the toner was observed.

Fifth Embodiment

Under the same conditions as the first embodiment, the image formation was conducted in the following manner. A conductive urethane rubber layer was integrally formed on a shaft made of stainless steel. A magnetic coating material in which carbon black functioning as conductive powder and barium ferrite functioning as magnetic powder were dispersed was applied in a thickness of about 50 μm to the outer surface of the rubber layer. The magnetization was conducted with a small pitch, or with a magnetization inversion pitch of 40 μm, thereby obtaining a toner carrier in which the rubber hardnesss (JIS A) was 50 deg., the outer diameter was 20 mm, the thickness of the rubber layer was 6 mm, and the resistance according to the resistance measuring method of FIG. 7 was $10^7\Omega$. An EPDM foam layer was formed on a shaft made of stainless steel as a foamed member having the cell density d of 5 cells/mm (the average foam cell diameter was about 200 μm), thereby forming a supply member in which the rubber hardness (JIS A) was 33 deg., the outer diameter was 12.2 mm, and the thickness of the foam layer was 3.1 mm. The supply member was pressingly contacted with the toner carrier in such a manner that the center distance between the toner carrier and the supply member was 16 mm. A regulation member in which the front end of a plate spring made of stainless steel and having a thickness of 0.1 mm was bent into an L-like shape was pressingly contacted with the toner carrier with a contact pressure of 5 gf/mm. As a result, dot images of 300 DPI and line images were stably formed without increasing the width of a line, and high-resolution images excellent in area gray-scale were formed. Furthermore, clear character images without background fogging were formed, and high-density solid images of an OD value of 1.4 or more and without uneven density were stably formed. The increase in the driving torque and the variation of the rotational velocity of the toner carrier, etc. were not observed images of a reduced printing jitter level and a reduced background fogging level were continuously formed. Moreover, the fixation and fusion of the toner to the toner carrier, the supply member and the regulation member were not observed. No damage of the toner was observed. Even when the supply member was rotated at a peripheral velocity smaller than that of the toner carrier, the sufficient supply of toner was able to be continued, and, even the contact force of the regulation member was reduced, the thinning of the toner was able to be stably continued.

Sixth Embodiment

The developing device and image forming apparatus shown in FIG. 2 were constructed using a toner carrier, a supply member and a regulation member listed in (1) to (3) below. Image forming operations were conducted while using one-component non-magnetic toner of a volume average particle diameter of 9 μm, and applying a developing bias voltage to the toner carrier and the supply member.

(1) Toner carrier

A conductive closed-cell polyurethane foam layer having an average foam cell diameter of about 20 μm was formed on a shaft made of stainless steel. The outer surface of the foam layer was covered using heat and an adhesive by a flexible layer of a thickness of about 100 μm in which a conductive heat-shrinkable urethane tube was used, thereby obtaining a toner carrier in which the rubber hardness (JIS A) was 35 deg., the outer diameter was 20 mm, the thickness of the foam layer was 6 mm, and the resistance according to the resistance measuring method of FIG. 7 was $10^6\Omega$.

(2) Supply member

An open-cell polyurethane foam layer was formed on a shaft made of stainless steel as a foamed member having the cell density d of 5 cells/mm (the average foam cell diameter was about 200 μm), thereby forming a supply member in which the rubber hardness (JIS A) was 30 deg., the outer diameter was 12.5 mm, and the thickness of the foam layer was 3.25 mm. The supply member was pressingly contacted with the toner carrier in such a manner that the center distance between the toner carrier and the supply member was 16 mm.

(3) Regulation member

The front end of a plate made of stainless steel and having a thickness of 3 mm was chamfered, and was pressingly contacted with the toner carrier with a contact pressure of 5 gf/mm.

Using the thus configured developing device, a pattern including a gray-scale image of a resolution of 300 DPI, a line image, a solid image and a character image was continuously formed on 5,000 sheets. Dot images of 300 DPI and line images were stably formed without increasing the width of a line, and high resolution images excellent in area gray-scale were formed. Furthermore, clear character images without background fogging were formed, and high-density solid images of an OD value of 1.4 or more and without uneven density were stably formed. The driving torque of the toner carrier, etc. was slightly increased, but the variation of the rotational velocity was not observed. Images of a reduced printing jitter level and a reduced background fogging level were continuously formed. Moreover, the fixation and fusion of the toner to the toner carrier, the supply member and the regulation member were not observed. No damage of the toner was observed.

As a comparison, the image formation was conducted under the same conditions except that another developing device configured in the following manner was used. A conductive closed-cell polyurethane foam layer having an average foam cell diameter of about 20 μm was formed on a shaft made of stainless steel. The outer surface of the foam layer was covered using heat and an adhesive by a flexible layer of a thickness of about 100 μm in which a conductive heat-shrinkable urethane tube was used, thereby obtaining a toner carrier in which the rubber hardness (JIS A) was 65 deg., the outer diameter was 20 mm, the thickness of the foam layer was 6 mm, and the resistance was $10^5\Omega$. An aluminum cylinder was subjected to the sand blasting to form a supply member in which the surface roughness in the term of Rz was 20 μm, and the outer diameter was 12.5 mm. The supply member was pressingly contacted with the toner carrier. The front end of a plate spring made of stainless steel and having a thickness of 0.1 mm was bent into an L-like shape. The vicinity of the front end was pressingly contacted with the toner carrier with a contact pressure of 5 gf/mm. As a result, the driving torques of the toner carrier and the supply member were extremely increased, and the variation of the rotational velocity was produced. It was observed with the naked eye that there were printing jitters which are traversal lines caused by sharp density unevenness. All images were blurred, and many voids were produced in solid images. The regulation member vibrated so that the toner was unevenly carried onto the toner carried with the result that there occurred density unevenness due to this uneven carrying.

The image formation was conducted under the same conditions except that a further developing device configured in the following manner was used. A conductive closed-cell polyurethane foam layer having an average foam cell diameter of about 20 μm was formed on a shaft made of stainless steel. The outer surface of the foam layer was covered using heat and an adhesive by a flexible layer of a thickness of about 100 μm in which a conductive heat-shrinkable urethane tube was used, thereby obtaining a toner carrier in which the rubber hardness (JIS A) was 35 deg., the outer diameter was 20 mm, the thickness of the foam layer was 6 mm, and the resistance was $10^6\Omega$. An open-cell polyurethane foam layer was formed on a shaft made of stainless steel as a foamed member having the cell density d of 5 cells/mm (the average foam cell diameter was about 200 μm), thereby forming a supply member in which the rubber hardness (JIS A) was 30 deg., the outer diameter was 12.5 mm, and the thickness of the foam layer was 3.25 mm, The supply member was pressingly contacted with the toner carrier. A regulation member in which the front end of a plate spring made of stainless steel and having a thickness of 0.1 mm was bent into an L-like shape was pressingly contacted with the toner carrier with a contact pressure of 5 gf/mm. As a result, in the initial stage, dot images of 300 DPI and line images were formed, and high-density solid images of an OD value of 1.4 or more were formed. However, the toner layer on the toner carrier was not sufficiently thinned, so that the background fogging was gradually increased in level as the printing number was increased. When the image forming apparatus was restarted after it was once stopped, the driving torque of the toner carrier was increased and the developing device vibrated. It seems that this was caused by the phenomenon in which the front end of the regulation member bit into the toner carrier. After the printing test, the observation of the regulation member indicated that a small crease was formed in the vicinity of the fixed end of the regulation member.

Seventh Embodiment

Under the same conditions as Sixth Embodiment, the image formation was conducted in the following manner. A conductive closed-cell polyurethane foam layer having an average foam cell diameter of about 20 μm was formed on a shaft made of stainless steel. The outer surface of the foam layer was covered using heat and an adhesive by a flexible layer of a thickness of about 100 μm in which a conductive heat-shrinkable urethane tube was used, thereby obtaining a toner carrier in which the rubber hardness (JIS A) was 35 deg., the outer diameter was 20 mm, the thickness of the foam layer was 6 mm, and the resistance according to the resistance measuring method of FIG. 7 was $10^6\Omega$. An open-cell polyurethane foam layer was formed on a shaft made of stainless steel as a foamed member having the cell density d of 5 cells/mm (the average foam cell diameter was about 200 μm), thereby forming a supply member in which the rubber hardness (JIS A) was 30 deg., the outer diameter was 12.5 mm, and the thickness of the foam layer was 3.25 mm. The supply member was pressingly contacted with the toner carrier in such a manner that the center distance between the toner carrier and the supply member was 16 mm. A polyurethane resin was injection molded to form a plate-like regulation member of a thickness of 4 mm and having a curved front end. The image formation was conducted while the front end portion was pressingly contacted with the toner carrier with a contact pressure of 5 gf/mm. Dot images of 300 DPI and line images were stably formed without increasing the width of a line, and high resolution images excellent in area gray-scale were formed. Furthermore, clear character images without background fogging were formed, and high-density solid images of an OD value of 1.4 or more and without uneven density were stably formed. The driving torque of the toner carrier, etc. was slightly increased, but the variation of the rotational velocity was not observed. Images of a reduced printing jitter level and a reduced background fogging level were continuously formed. Moreover, the fixation and fusion of the toner to the toner carrier, the supply member and the regulation member were not observed. No damage of the toner was observed.

Eighth Embodiment

Under the same conditions as Sixth Embodiment, the image formation was conducted in the following manner. A conductive open-cell silicone rubber foam layer was formed on a shaft made of stainless steel. The silicone rubber foam layer had a sold surface layer portion at its surface, and its foam cell diameter at its center portion was about 200 μm. A magnetic coating material in which carbon black functioning as conductive powder and barium ferrite functioning as magnetic powder were dispersed was applied in a thickness of about 50 μm to the outer surface of the silicone rubber foam layer. The magnetization was conducted with a minute pitch, or with a magnetization inversion pitch of 40 μm, thereby obtaining a toner carrier in which the rubber hardness (JIS A) was 35 deg., the outer diameter was 20 mm, the thickness of the rubber layer was 6 mm, and the resistance according to the resistance measuring method of FIG. 7 was $10^3\Omega$. An open-cell polyurethane foam layer was formed on a shaft made of stainless steel as a foamed member having the cell density d of 5 cells/mm (the average foam cell diameter was about 200 μm), thereby forming a supply member in which the rubber hardness (JIS A) was 30 deg., the outer diameter was 12.2 mm, and the thickness of the foam layer was 3.1 mm. The supply member was presssingly contacted with the toner carrier in such a manner that the center distance between the toner carrier and the supply member was 16 mm. A polyurethane resin was injection molded to form a plate-like regulation member of a thickness of 4 mm and having a curved front end. The image formation was conducted while the front end portion was pressingly contacted with the toner carrier with a contact pressure of 5 gf/mm. Dot images of 300 DPI and line images were stably formed without increasing the width of a line, and high resolution images excellent in area gray-scale were formed. Furthermore, clear character images without background fogging were formed, and high-density solid images of an OD value of 1.4 or more and without uneven density were stably formed. The increase in the driving torque and the variation of the rotational velocity of the toner carrier, etc, were not observed. Images of a reduced printing jitter level and a reduced background fogging level were continuously formed. Moreover, the fixation and fusion of the toner to the toner carrier, the supply member and the regulation member were not observed. No damage of the toner was observed. Even when the supply member was rotated at a peripheral velocity smaller than that of the toner carrier, the sufficient supply of toner was able to be continued.

Ninth Embodiment

The developing device and image forming apparatus shown in FIG. 1 were constructed using a toner carrier, a supply member and a regulation member listed in (1) to (3) below. Image forming operations were conducted while using one-component non-magnetic toner of a volume average particle diameter of 9 μm, applying a developing bias voltage to the toner carrier, the supply member and the regulation member, and setting the peripheral velocity $V_1$ of the toner carrier to be 32 mm/sec and the peripheral velocity $V_2$ of the supply member to be 32 mm/sec.

(1) Toner carrier

A conductive urethane rubber layer was formed on a shaft made of stainless steel. The outer surface of the rubber layer was polished. Thereafter, only the outer surface layer was subjected to a hardening process using a coupling agent to obtain a toner carrier in which the surface roughness in the term of Rz was 5 μm, the rubber hardness (JIB A) was 53 deg., the outer diameter was 20 mm, the thickness of the rubber layer was 6 mm, and the resistance according to the resistance measuring method of FIG. 7 was $10^7\Omega$.

(2) Supply member

Two open-cell conductive EPDM foam layers having a different cell density d were formed on a shaft made of stainless steel as a foamed member, thereby forming a supply member in which the outer diameter was 12.5 mm, and the thickness of the foam layer was 3.25 mm. The supply member was pressingly contacted with the toner carrier while setting the contact pressure f to the following conditions:

| | |
|---|---|
| Condition A: | cell density d = 9 cells/mm<br>contact pressure f = 5 gf/mm |
| Condition B: | cell density d = 0.5 cells/mm<br>contact pressure f = 1 gf/mm |

(3) Regulation member

The front end of a plate spring made of stainless steel and having a thickness of 0.1 mm was bent into an L-like shape. The vicinity of the front end of the regulation member was pressingly contacted with the toner carrier with a contact pressure of 5 gf/mm.

Figure 9:
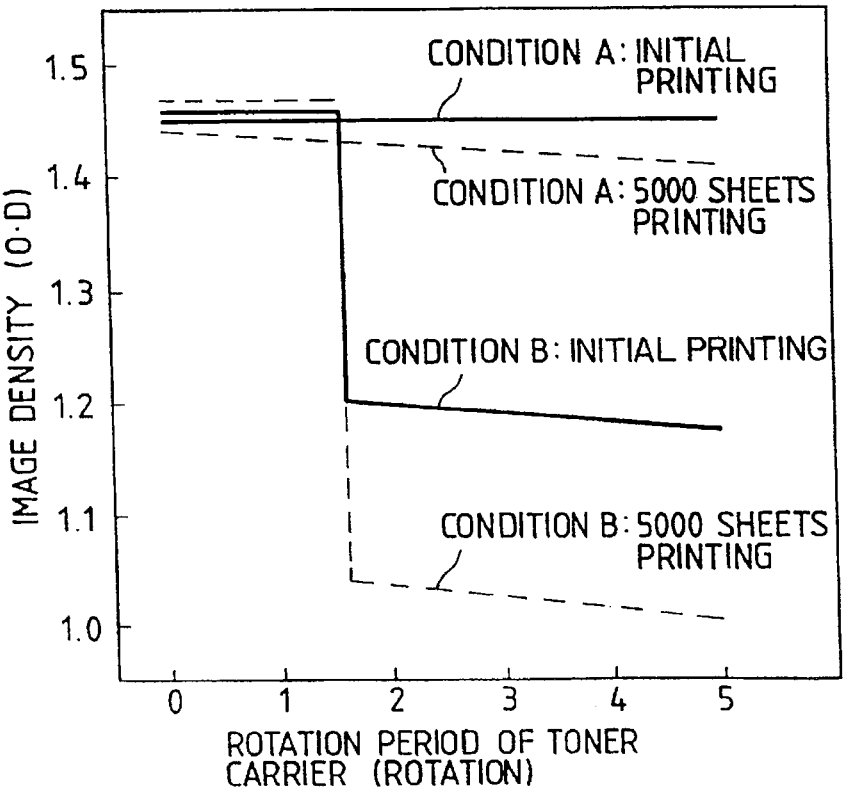
FIG. 9 is a graph showing the relationship between the rotation period of a toner carrier and the image density in a developing device which is an embodiment of the invention.

Using the thus configured developing device, a pattern including a gray-scale image of a resolution of 300 DPI, a line image, a solid image and a character image was continuously formed on 5,000 sheets. FIG. 9 shows the relationship between the rotation period of the toner carrier and the image density obtained when a black solid image continuous in the developing direction was formed using the thus configured developing device and image forming apparatus. Condition A is a typical embodiment of the invention, and condition B is a comparative example of the invention.

When the developing device was constructed using the foamed member according to condition A, black solid images were obtained with a high image density (OD≧1.4) and in a uniform manner irrespective of the rotation period of the toner carrier. Even after the printing process was continuously conducted on 5,000 sheets, image defects such as a reduced density of block solid images and ghosts were not observed. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. No damage of the toner was observed.

In contrast, when the developing device was constructed using the foamed member according to condition B, black solid images were obtained with a high image density (OD≧1.4) in the leading end portion in the first rotation period of the toner carrier. In the rear end portions in the second and subsequent rotation periods of the toner carrier, the image density was reduced (OD≦1.2) and a ghost was formed. After the continuous printing process of 5,000 sheets, the image density was greatly reduced and the degree of a ghost was further impaired as compared with that of a ghost obtained in the initial stage.

The reason why, under the condition B, the image density of a black solid image obtained in the rear end portions in the second and subsequent rotation periods of the toner carrier was lower than that obtained in the leading end portion in the first rotation period is as follows: In the first rotation period of the toner carrier, the toner layer on the surface of the toner carrier exhibits a sufficient adhesive force due to the image-force as a result of several processes of triboelectric charging with the regulation member and the toner carrier. Therefore, the toner layer is liable to be closely packed so as to become a relatively thick layer. By contrast, in the second and subsequent rotation periods of the toner carrier, depending on the toner supply capacity and toner-layer forming capacity of the supply member, the toner is scattered and forms a relatively thin toner layer when the toner supply and the triboelectric charging are insufficient. This phenomenon tends to become notable when the flowability or triboelectric charging ability of the toner is lowered. This is the reason why a black solid image obtained in the rear end portions in the second and subsequent rotation periods of the toner carrier after the continuous printing process of 5,000 sheets according to condition B is remarkably lowered in image density. When a supply member constructed by a foamed member having a predetermined cell density as condition A is disposed so as to be pressed against a toner carrier with a predetermined contact pressure, however, toner in the first rotation period of the toner carrier which is to be formed as a toner layer on the surface of the toner carrier is scraped off by the supply member and replaced with fresh toner, resulting in that the toner is hardly formed as a dense and thick layer. Furthermore, also toner in the second and subsequent rotation periods of the toner carrier is efficiently triboelectrically charged under an appropriate contact pressure exerted by the supply member, so as to exhibit a sufficient adhesion force on the surface of the toner carrier. Therefore, toner in the first rotation period of the toner carrier and also toner in the second and subsequent rotation periods can be formed as a layer on the toner carrier in a homogeneous manner. As a result, when the developing device is constructed using the foamed member according to condition A, black solid images of high and uniform density can be obtained irrespective of the rotation period of the toner carrier even after the printing process is continuously conducted on 5,000 sheets.

Tenth Embodiment

The developing device and image forming apparatus shown in FIG. 1 were constructed using a toner carrier, a supply member, a regulation member and an auxiliary charging member listed in (1) to (4) below. Image forming operations were conducted while using one-component non-magnetic toner of a volume average particle diameter of 9 μm, applying a developing bias voltage to the toner carrier, the supply member and the regulation member so that the supply member and the auxiliary charging member have the same potential, and setting the peripheral velocity $V_1$ of the toner carrier to be 32 mm/sec and the peripheral velocity $V_2$ of the supply member to be 32 mm/sec.

(1) Toner carrier

A conductive urethane rubber layer was formed on a shaft made of stainless steal. The outer surface of the rubber layer was polished. Thereafter, only the outer surface later was subjected to a hardening process using a cross linking agent to obtain a toner carrier in which the surface roughness in the term of Rz was 5 μm, the rubber hardness (JIB A) was 55 deg., the outer diameter was 20 mm, the thickness of the rubber layer was 6 mm, and the resistance according to the resistance measuring method of FIG. 7 was $10^7\Omega$.

(2) Supply member

Seven open-cell conductive polyurethane foam layers having a different cell density d (0.5 to 32 cells/m) were formed on a shaft made of stainless steel as a foamed member, thereby forming a supply member in which the outer diameter was 12.5 mm, and the thickness of the foam layer was 3.25 mm. The supply member was pressingly contacted with the toner carrier while changing the contact pressure f to the toner carrier in the range of 1 to 35 gf/mm.

(3) Regulation member

The front end of a plate spring made of stainless steel and having a thickness of 0.1 mm was bent into an L-like shape. The vicinity of the front end of the regulation member was pressingly contacted with the toner carrier with a contact pressure of 5 gf/mm.

(4) Auxiliary charging member

The front end of a plate spring made of stainless steel and having a thickness of 0.1 mm was bent into an L-like shape. The vicinity of the front end was pressingly contacted with the supply member with a contact pressure of 1 gf/mm. It was confirmed that stainless constituting the auxiliary charging member exists in the positive polarity side with respect to the triboelectric charging of the toner used in the embodiment in the triboelectric series and easily electrifies the toner to the negative polarity.

Figure 8:
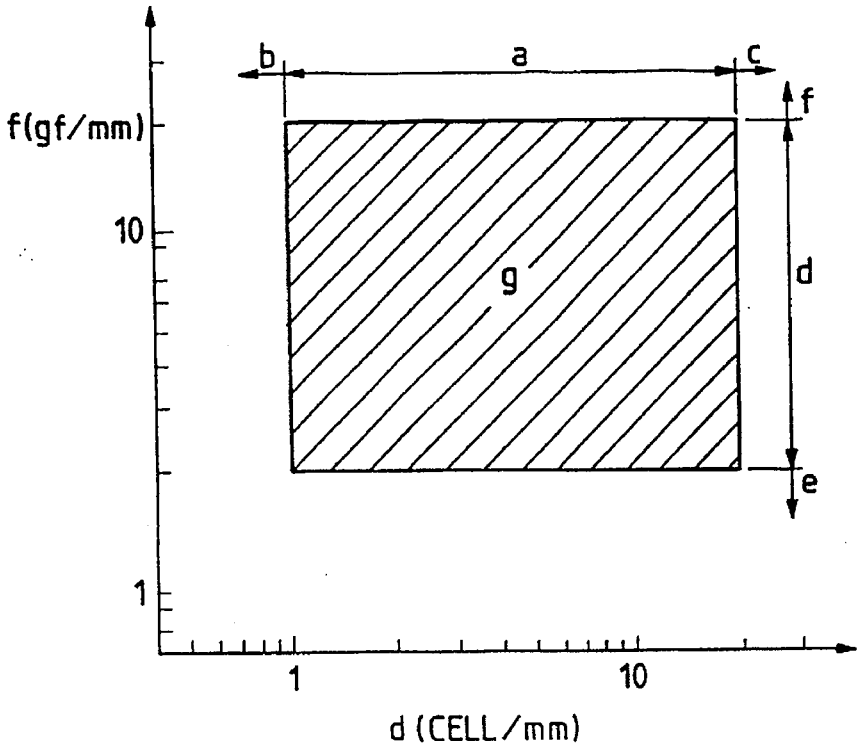
FIG. 8 is diagram showing the relationship among the cell density of a foamed member constituting a supply member of a developing device which is an embodiment of the invention, a contact pressure of the supply member against a toner carrier, and a practical range where an excellent solid image can be developed.

Using the thus configured developing device, a pattern including a gray-scale image of a resolution of 300 DPI, a line image, a solid image and a character image was continuously formed on 5,000 sheets. FIG. 8 shows the practical disposition range of the developing device in which the foamed member constituting the supply member has the cell density d and the supply member is pressingly contacted with the toner carrier with the contact pressure f. In the range, the developing device can excellently develop solid images continuous in the developing direction, without causing the reduced image density in the rear end portion of a solid image and causing the fluctuation of the rotational velocity. A region a indicates the range where the cell density of the surface layer portion of the supply member is 1 to 20 cells/mm, and a region d indicates the range where the contact pressure of the supply member against the toner carrier is 2 to 20 gf/mm. A sufficient image density (OD≧1.3) in the rear end portion of a black solid image was obtained in a region g where the regions a and d overlap with each other. In the region g, a reduced number of ghosts were formed. In a subregion of the region g where a supply member of the cell density of 2 to 12 cells/mm is disposed so as to exert the contact pressure of 4 to 15 gf/mm, a higher image density (OD≧1.4) was obtained and no ghost was formed, thereby producing very excellent results. In a region b or c, or when a developing device is provided with a supply member having a surface layer portion of a cell density of 1 cell/mm or less or 20 cells/mm or more, the density of rear end portion of a solid image is reduced. In such a developing device, the supply member was not able to substantially supply the toner to the toner carrier to cause, thereby producing a state where the toner was insufficiently carried. In a region e, the developing device where the contact pressure of the supply member against the toner carrier is less than 2 gf/mm produces a reduced image density in the rear end portion of a solid image. In this developing device, although a sufficient amount of toner was supplied to the toner carrier, the formation of the toner layer on the toner carrier was not uniformly conducted, and the toner was unevenly carried. A region f where the contact pressure of the supply member against the toner carrier is greater than 20 gf/mm is not included in the practical range in which an excellent solid image can be developed, because the frictional resistance between the supply member and the toner carrier caused the driving torque to increase to a level exceeding the allowable load limit of the driving motor of the developing device, thereby making the operation unstable or forming jitters. When the developing device was constructed so as to have a supply member in the range g, therefore, no background fogging was formed in a nonimage area, and images excellent in character developing and line image developing properties and area gray-scale were formed with superior reproducibility. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. Aggregation of toner, and abrasion and damage of the supply member were not produced.

Eleventh Embodiment

The developing device and image forming apparatus shown in FIG. 1 were constructed using a toner carrier, a supply member, a regulation member and an auxiliary charging member listed in (1) to (4) below. Image forming operations were conducted while using one-component non-magnetic toner of a volume average particle diameter of 9 μm, applying a developing bias voltage to the toner carrier, the supply member and the regulation member so that the supply member and the auxiliary charging member have the same potential, and setting the peripheral velocity $V_1$ of the toner carrier to be 32 mm/sec and the peripheral velocity $V_2$ of the supply member to be 32 mm/sec.

(1) Toner carrier

A conductive urethane rubber layer was formed on a shaft made of stainless steel. The outer surface of the rubber layer was polished. Thereafter, only the outer surface layer was subjected to a hardening process using a cross linking agent to obtain a toner carrier in which the surface roughness in the term of Rz was 5 μm, the rubber hardness (JIS A) was 55 deg., the outer diameter was 20 mm, the thickness of the rubber layer was 6 mm, and the resistance according to the resistance measuring method of FIG. 7 was $10^7\Omega$.

(2) Supply member

Four open-cell conductive polyurethane foam layers having a different permanent compression set (cell density d=2 to 12 cells/mm) were formed on a shaft made of stainless steel, thereby forming a supply member in which the outer diameter was 12.5 mm, and the thickness of the foam layer was 3.25 mm. The supply member was pressingly contacted with the toner carrier while changing the contact pressure f to the toner carrier in the range of 2 to 15 gf/mm.

(3) Regulation member

The front end of a plate sprang made of stainless steel and having a thickness of 0.1 mm was bent into an L-like shape. The vicinity of the front end of the regulation member was pressingly contacted with the toner carrier with a contact pressure of 5 gf/mm.

(4) Auxiliary charging member

The front end of a plate spring made of stainless steel and having a thickness of 0.1 mm was bent into an L-like shape. The vicinity of the front end was pressingly contacted with the supply member with a contact pressure of 1 gf/mm. It was confirmed that stainless constituting the auxiliary charging member exists in the positive polarity side with respect to the triboelectric charging of the toner weed in the embodiment in the triboelectric series and easily electrifies the toner to the negative polarity.

Table 1 below indicates results of developing processes in which, using the thus configured developing device, a pattern including a gray-scale image of a resolution of 300 DPI, a line image, a solid image and a character image was continuously formed. In the table, ○ and x respectively indicate the existence and nonexistence of an image defect which was produced in developing process conducted after the developing device were allowed to stand for 7 days. When five sheets on which an excellent solid image continuous in the developing direction was formed were successively obtained, it was judged to be ○. When streaks (voids, etc.) were in an rotation period of the toner carrier but they were not formed in the subsequent developing of several sheets, it was judged to be Δ. When streaks were formed on successive several sheets, it was judged to be x.

TABLE 1

| f(gf/mm) | Foamed member | A | B | C | D |
|---|---|---|---|---|---|
| 2 | Permanent compression (%) | 8 | 22 | 28 | 36 |
| | Image defect | ○ | ○ | ○ | X |
| 3 | Permanent compression (%) | 8 | 18 | 31 | 40 |
| | Image defect | ○ | ○ | Δ | X |
| 7 | Permanent compression (%) | 10 | 21 | 29 | 39 |
| | Image defect | ○ | ○ | Δ | X |
| 15 | Permanent compression (%) | 12 | 24 | 33 | 37 |
| | Image defect | ○ | ○ | Δ | X |

Under the above conditions, no background fogging was formed in a nonimage area, and images excellent in character developing and line image developing properties and area gray-scale were formed with superior reproducibility. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. Aggregation of toner, and abrasion and damage of the supply member were not produced.

Twelfth Embodiment

The developing device and image forming apparatus shown in FIG. 1 and using a toner carrier, a supply member and a regulation member which are the same as those in First Embodiment were constructed. Image forming operations were conducted while using one-component non-magnetic toner of a volume average particle diameter of 9 μm, and arranging these components in such a manner that the angles α and β shown in FIG. 4 were 30 deg. and 45 deg., respectively.

Using the thus configured developing device, a pattern including a gray-scale image of a resolution of 300 DPI, a line image, a solid image and a character image was continuously formed on 5,000 sheets. Dot images of 300 DPI and line images were stably formed without increasing the width of a line, and high resolution images excellent in area gray-scale were formed. Furthermore, clear character images without background fogging were formed, and high-density solid images of an OD value of 1.4 or more and without uneven density were stably formed. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. No damage of the toner was observed. It was confirmed that the application of the developing bias voltage to at least two of the toner carrier, the supply member and the regulation member allowed the normal image formation to be conducted. When the developing bias voltage was applied only to the supply member or the regulation member, however, the toner carry amount fluctuated, and only images with large density unevenness were obtained.

In contrast, using a developing device in which α was 30 deg. and β was 120 deg., a pattern including a gray-scale image of a resolution of 300 DPI, a lane image, a solid image and a character image was continuously formed on 5,000 sheets. In the early stage, dot images of 300 DPI and line images were stably formed without increasing the width of a line, and high resolution images excellent in area gray-scale were formed. After the developing process was conducted on several tens sheets, however, the toner carry amount on the toner carrier become unstable, and the density unevenness and the ground fogging were produced in the printed sheets. The density unevenness was gradually notable as the printing number was increased, resulting in that, after the developing process was conducted on 1,000 sheets, longitudinal band-like white voids were occasionally formed in the printed sheets. After the developing process was conducted on 5,000 sheets, a toner layer which firmly stuck to the front end portion of the regulation member. The developing bias voltage was applied to the toner carrier, the supply member and the regulation member.

Thirteenth Embodiment

The developing device and image forming apparatus shown in FIG. 1 and using a toner carrier, a supply member and a regulation member which are the same as those in Sixth Embodiment were constructed. Image forming operations were conducted while using one-component non-magnetic toner of a volume average particle diameter of 9 μm, and arranging these components In such a manner that the angles α and β shown in FIG. 4 were 30 deg. and 45 deg., respectively.

Using the thus configured developing device, a pattern including a gray-scale image of a resolution of 300 DPI, a line image, a solid image and a character image was continuously formed on 5,000 sheets. Dot images of 300 DPI and line images were stably formed without increasing the width of a line, and high resolution images excellent in area gray-scale were formed. Furthermore, clear character images without background fogging were formed, and high-density solid images of an OD value of 1.4 or more and without uneven density were stably formed. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. No damage of the toner was observed. It was confirmed that the application of the developing bias voltage to at least two of the toner carrier, the supply member and the regulation member allowed the normal image formation to be conducted. When the developing bias voltage was applied only to the supply member or the regulation member, however, the toner carry amount fluctuated, and only images with large density unevenness were obtained.

In contrast, using a developing device in which α was 40 deg. and β was 0 deg., a pattern including a gray-scale image of a resolution of 300 DPI, a line image, a solid image and a character image was continuously formed on 50 sheets. In the developing for first several sheets, the toner was thinned, and the 300 DPI dot image and the line image were stably formed without increasing the width of a line, and high resolution images excellent in area gray-scale were formed. After the developing process was conducted on several sheets, however, the toner carry amount on the toner carrier was increased, and the density unevenness and the ground fogging were produced in the printed sheets. The developing bias voltage was applied to the toner carrier, the supply member and the regulation member.

Fourteenth Embodiment

The developing device and image forming apparatus shown in FIG. 1 were constructed using a toner carrier, a supply member and a regulation member listed in (1) to (3) below. Image forming operations were conducted while using one-component non-magnetic toner of a volume average particle diameter of 9 μm, applying a developing bias voltage to the toner carrier, the supply member and the regulation member, and setting the peripheral velocity $V_1$ of the toner carrier to be 32 m/sec and the peripheral velocity $V_2$ of the supply member to be 32 m/sec.

(1) Toner carrier

A conductive urethane rubber layer was formed on a shaft made of stainless steel. The outer surface of the rubber layer was polished. Thereafter, only the outer surface layer was subjected to a hardening process using heat or light to obtain a toner carrier in which the surface roughness in the term of Rz was 5 μm, the rubber hardness (JIS A) was 50 deg., the outer diameter was 20 mm, the thickness of the rubber layer was 6 mm, and the resistance according to the resistance measuring method of FIG. 7 was $10^7\Omega$.

(2) Supply member

Seven open-cell conductive polyurethane foam layers having a different cell density d (0.5 to 32 cells/m) were formed on a shaft made of stainless steel as a foamed member, thereby forming a supply member in which the outer diameter was 12.5 mm, and the thickness of the foam layer was 3.25 mm. The supply member was pressingly contacted with the toner carrier while changing the contact pressure f to the toner carrier in the range of 1 to 35 gf/mm.

(3) Regulation member

The front end of a plate spring made of stainless steel and having a thickness of 0.1 mm was bent into an L-like shape. The vicinity of the front end of the regulation member was pressingly contacted with the toner carrier with a contact pressure of 5 gf/mm.

Figure 10A:
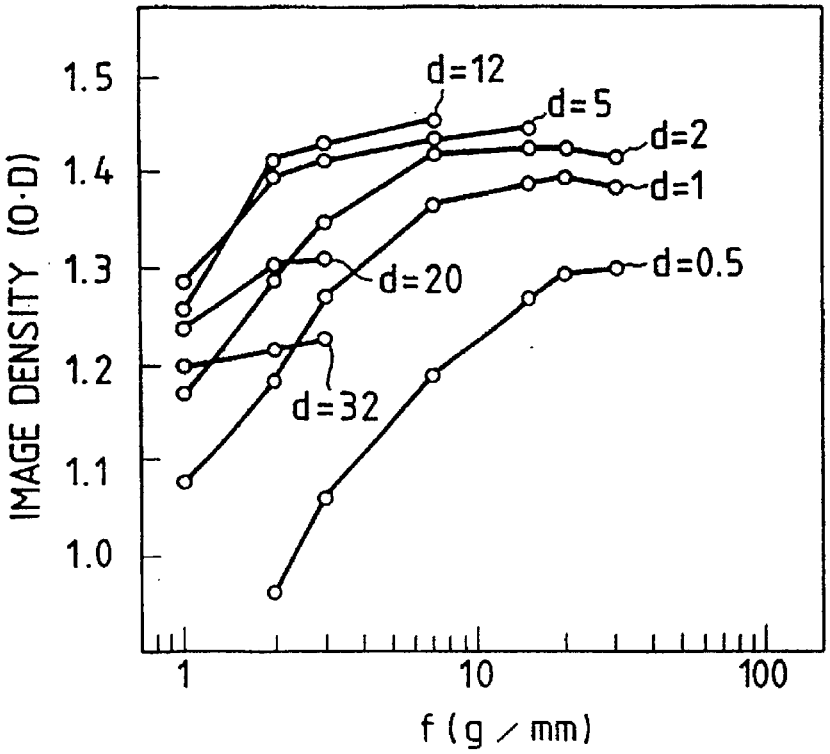
FIG. 10(*a*) and (*b*) show the relationship between image output properties and a contact pressure of a supply member against a toner carrier in a developing device which is an embodiment of the invention.
Figure 10B:
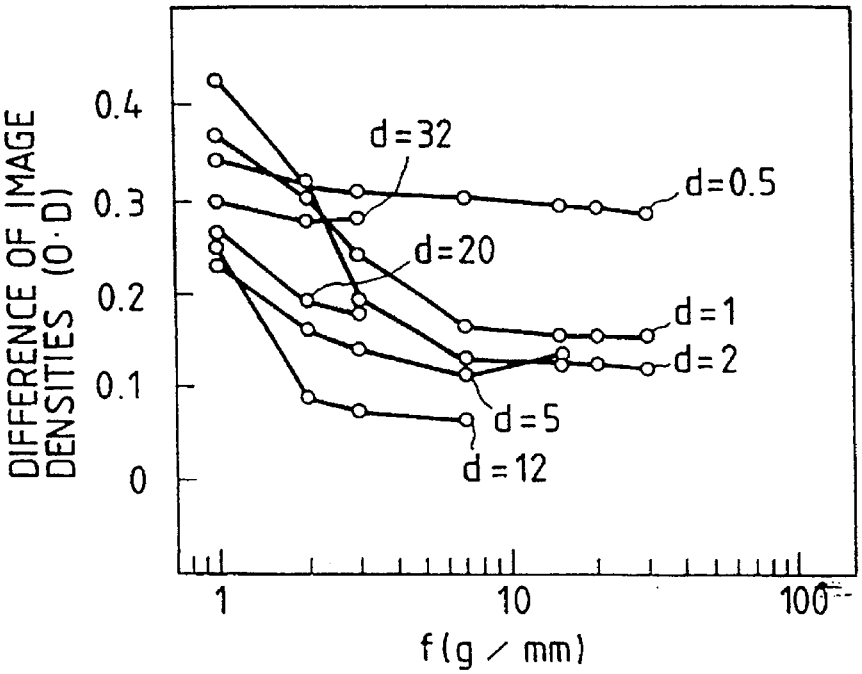

Using the thus configured developing device, a pattern including a gray-scale image of a resolution of 300 DPI, a line image, a solid image and a character image was continuously formed on 5,000 sheets. FIG. 10 shows the relationship between output images of the developing device and the contact pressure exerted on the toner carrier by the supply member constructed by a foamed member having surface layer portions of a different cell density. In FIG. 10, (a) is a graph showing the reduction of the density in the rear end of a black solid image, in the term of the relationship between the contact pressure f of the supply member and the image density (OD) in the rear end of a black solid image, and (b) is a graph showing the degree of a ghost which was formed by the consumption hysteresis on the toner carrier corresponding to the subsequent rotation periods of the toner carrier, in the term of the relationship between the contact pressure f of the supply member and the difference of the image densities (OD) of a black solid image respectively corresponding to a toner-consumed portion and a toner-unconsumed portion on the toner carrier. When a solid image is developed in the next rotation period of the toner carrier, the difference between a toner-consumed portion and a toner-unconsumed portion on the toner carrier allows a high image density to be produced in the area corresponding to the toner-unconsumed portion, and causes a reduction in image density in the area corresponding to the toner-consumed portion in the case where the toner is insufficiently supplied. This difference appears as the difference of image densities or a ghost. As a method of indicating the degree of a ghost, the figure shows a density difference of a solid image which appeared in the next rotation period of a developing roller in correspondence with a toner-consumed portion and a toner-unconsumed portion.

Table 2 below summarizes as a list the results shown in FIG. 10. The criterion will be described. The symbol indicates a result which satisfies the conditions that the image density of a black solid image is 1.3 or more and the image density difference indicative of a ghost is smaller than 0.2. The symbol "Δ" indicates a result which satisfies the conditions that the image density of a black solid image is 1.3 or more and the image density difference indicative of a ghost is 0.2 to 0.3, the conditions that the image density of a black solid image is 1.2 to 1.3 and the image density difference indicative of a ghost is smaller than 0.2, or the conditions that the image density of a black solid image is 1.2 to 1.3 and the image density difference indicative of a ghost is 0.2 to 0.3. The symbol "x" indicates a result which satisfies the conditions that the image density of a black solid image is smaller than 1.2 and the image density difference indicative of a ghost is smaller than 0.3. The symbol "–" indicates a result in which the image formation was not conducted in the developing device used in the embodiment because of an excessively large driving load of the developing device.

Under the conditions indicated by "○" in Table 2, dot images of 300 DPI and line images were stably formed without increasing the width of a line, and high resolution images excellent in area gray-scale were formed. Furthermore, clear character images without background fogging were formed, and high-density solid images of an OD value of 1.3 or more and without uneven density were stably formed. Under the above conditions, no background fogging was formed in a nonimage area, and images excellent in character developing and lane image developing properties and area gray-scale were formed with superior reproducibility. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. Aggregation of toner, and abrasion and damage of the supply member were not produced.

TABLE 2

| d (Cell/mm) | 0.5 | 1 | 2 | 5 | 12 | 20 | 32 |
|---|---|---|---|---|---|---|---|
| f = 1 (gf/mm) | X | X | X | Δ | Δ | Δ | Δ |
| f = 2 (gf/mm) | X | X | X | ○ | ○ | ○ | Δ |
| f = 3 (gf/mm) | X | Δ | ○ | ○ | ○ | ○ | Δ |

TABLE 2-continued

| d (Cell/mm) | 0.5 | 1 | 2 | 5 | 12 | 20 | 32 |
|---|---|---|---|---|---|---|---|
| f = 7 (gf/mm) | X | ○ | ○ | ○ | ○ | — | — |
| f = 15 (gf/mm) | Δ | ○ | ○ | ○ | — | — | — |
| f = 20 (gf/mm) | Δ | ○ | ○ | — | — | — | — |
| f = 35 (gf/mm) | Δ | ○ | ○ | — | — | — | — |

Fifteenth Embodiment

Under the same conditions as Fourteenth Embodiment, the image formation was conducted while setting the toner carrier, so as to rotate at a peripheral velocity $V_1$ of 32 mm/sec and the supply member so as to rotate at a peripheral velocity $V_2$ of 6.4 mm/sec. Table 3 below shows a list of results obtained under the above conditions. The criterion of output images is the same as that of Fourteenth Embodiment.

Under the conditions indicated by "○" in Table 3, dot images of 300 DPI and lane images were stably formed without increasing the width of a line, and high resolution images excellent in area gray-scale were formed. Furthermore, clear character images without background fogging were formed, and high-density solid images of an OD value of 1.3 or more and without uneven density were stably formed. Under the above conditions, no background fogging was formed in a nonimage area, and images excellent in character developing and line image developing properties and area gray-scale were formed with superior reproducibility. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. Aggregation of toner, and abrasion and damage of the supply member were not produced.

TABLE 3

| d (Cell/mm) | 0.5 | 1 | 2 | 5 | 12 | 20 | 32 |
|---|---|---|---|---|---|---|---|
| f = 1 (gf/mm) | X | X | X | X | Δ | Δ | Δ |
| f = 2 (gf/mm) | X | X | X | Δ | ○ | ○ | Δ |
| f = 3 (gf/mm) | X | X | X | ○ | ○ | ○ | Δ |
| f = 7 (gf/mm) | X | Δ | ○ | ○ | ○ | ○ | — |
| f = 15 (gf/mm) | Δ | ○ | ○ | ○ | ○ | — | — |
| f = 20 (gf/mm) | Δ | ○ | ○ | ○ | — | — | — |
| f = 35 (gf/mm) | Δ | ○ | ○ | ○ | — | — | — |

Sixteenth Embodiment

Under the same conditions as Fourteenth Embodiment, the image formation was conducted while setting the toner carrier so as to rotate at a peripheral velocity $V_1$ of 32 mm/sec and the supply member so as to rotate at a peripheral velocity $V_2$ of 16 mm/sec. Table 4 below shows a list of results obtained under the above conditions. The criterion of output images is the same as that of Embodiment 14.

Under the conditions indicated by "○", in Table 4, dot images of 300 DPI and line images were stably formed without increasing the width of a line, and high resolution images excellent in area gray-scale were formed. Furthermore, clear character images without background fogging were formed, and high-density solid images of an OD value of 1.3 or more and without uneven density were stably formed. Under the above conditions, no background fogging was formed in a nonimage area, and images excellent in character developing and line image developing properties and area gray-scale were formed with superior reproducibility. The increase in the driving torque and the variation of the rotational velocity of the toner carrier, etc, were not observed. Images of a reduced printing jitter level and a reduced background fogging level were continuously formed. Moreover, the fixation and fusion of the toner to the toner carrier, the supply member and the regulation member were not observed. Aggregation of toner, and abrasion and damage of the supply member were not produced.

TABLE 4

| d (Cell/mm) | 0.5 | 1 | 2 | 5 | 12 | 20 | 32 |
|---|---|---|---|---|---|---|---|
| f = 1 (gf/mm) | X | X | X | Δ | Δ | Δ | Δ |
| f = 2 (gf/mm) | X | X | X | ○ | ○ | ○ | Δ |
| f = 3 (gf/mm) | X | X | Δ | ○ | ○ | ○ | Δ |
| f = 7 (gf/mm) | X | Δ | ○ | ○ | ○ | — | — |
| f = 15 (gf/mm) | Δ | ○ | ○ | ○ | — | — | — |
| f = 20 (gf/mm) | Δ | ○ | ○ | ○ | — | — | — |
| f = 35 (gf/mm) | Δ | ○ | ○ | — | — | — | — |

Seventeenth Embodiment

Under the same conditions as Embodiment 14, the image formation was conducted while setting the toner carrier so as to rotate at a peripheral velocity $V_1$ of 32 mm/sec and the supply member so as to rotate at a peripheral velocity $V_2$ of 64 mm/sec. Table 5 below shows a list of results obtained under the above conditions. The criterion of output images is the same as that of Embodiment 14.

TABLE 5

| d (Cell/mm) | 0.5 | 1 | 2 | 5 | 12 | 20 | 32 |
|---|---|---|---|---|---|---|---|
| f = 1 (gf/mm) | X | X | X | Δ | Δ | Δ | Δ |
| f = 2 (gf/mm) | X | X | Δ | ○ | ○ | ○ | — |
| f = 3 (gf/mm) | X | Δ | ○ | ○ | ○ | — | — |
| f = 7 (gf/mm) | Δ | ○ | ○ | ○ | — | — | — |
| f = 15 (gf/mm) | Δ | ○ | ○ | — | — | — | — |
| f = 20 (gf/mm) | Δ | ○ | ○ | — | — | — | — |
| f = 35 (gf/mm) | Δ | ○ | ○ | — | — | — | — |

Under the conditions indicated by "○" in Table 5, dot images of 300 DPI and line images were stably formed without increasing the width of a line, and high resolution images excellent in area gray-scale were formed. Furthermore, clear character images without background fogging were formed, and high-density solid images of an OD value of 1.3 or more and without uneven density were stably formed. Under the above conditions, no background fogging was formed in a nonimage area, and images excellent in character developing and line image developing properties and area gray-scale were formed with superior reproducibility. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. Aggregation of toner/and abrasion and damage of the supply member were not produced.

Eighteenth Embodiment

Under the same conditions as fourteenth Embodiment, the image formation was conducted while setting the toner carrier so as to rotate at a peripheral velocity $V_1$ of 32 mm/sec and the supply member so as to rotate at a peripheral velocity $V_2$ of 128 mm/sec. Table 6 below shows a list of results obtained under the above conditions. The criterion of output images is the same as that of Fourteenth Embodiment.

TABLE 6

| d (Cell/mm) | 0.5 | 1 | 2 | 5 | 12 | 20 | 32 |
|---|---|---|---|---|---|---|---|
| f = 1 (gf/mm) | X | X | Δ | Δ | Δ | Δ | Δ |
| f = 2 (gf/mm) | X | Δ | ○ | ○ | ○ | ○ | — |
| f = 3 (gf/mm) | Δ | ○ | ○ | ○ | — | — | — |
| f = 7 (gf/mm) | Δ | ○ | ○ | ○ | — | — | — |
| f = 15 (gf/mm) | Δ | ○ | ○ | — | — | — | — |
| f = 20 (gf/mm) | Δ | ○ | ○ | — | — | — | — |
| f = 35 (gf/mm) | Δ | ○ | — | — | — | — | — |

Under the conditions indicated by "○" in Table 6, dot images of 300 DPI and line images were stably formed without increasing the width of a line, and high resolution images excellent in area gray-scale were formed. Furthermore, clear character images without background fogging were formed, and high-density solid images of an OD value of 1.3 or more and without uneven density were stably formed. Under the above conditions, no background fogging was formed in a nonimage area, and images excellent in character developing and line image developing properties and area gray-scale were formed with superior reproducibility. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. Aggregation of toner, and abrasion and damage of the supply member were not produced.

Nineteenth Embodiment

The developing device and image forming apparatus shown in FIG. 6 were constructed using a toner carrier, a supply member and a regulation member listed in (1) to (3) below. Image forming operations were conducted while using one-component non-magnetic toner of a volume average particle diameter of 9 μm, and applying a developing bias voltage to the toner carrier, the supply member and the regulation member.

(1) Toner carrier

A conductive flexible polyurethane foam layer was formed on a shaft made of stainless steel to obtain a toner carrier in which the rubber hardness (JIS A) was 30 deg., the outer diameter was 20 mm, the thickness of the foam layer was 6 mm, and the resistance according to the resistance measuring method of FIG. 7 was $10^6\Omega$.

(2) Supply member

An aluminum cylinder was subjected to the sand blasting to form a supply member in which the surface roughness in the term of Rz was 20 μm, and the outer diameter was 12.5 mm. The supply member was pressingly contacted with the toner carrier in such a manner that the center distance between the toner carrier and the supply member was 16 mm.

(3) Regulation member

The front end of a plate made of stainless steel and having a thickness of 3 mm was chamfered, and was pressingly contacted with the toner carrier with a contact pressure of 5 gf/mm.

Using the thus configured developing device, a pattern including a gray-scale image of a resolution of 300 DPI, a line image, a solid image and a character image was continuously formed on 5,000 sheets. Dot images of 300 DPI and lane images were stably formed without increasing the width of a line, and high resolution images excellent in area gray-scale were formed. Furthermore, clear character images without background fogging were formed, and high-density solid images of an OD value of 1.4 or more and without uneven density were stably formed. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. No damage of the toner was observed.

As a comparison, the image formation wag conducted under the same conditions except that another developing device configured in the following manner was used. A conductive closed-cell polyurethane foam layer having an average foam cell diameter of about 20 μm was formed on a shaft made of stainless steel, thereby obtaining a toner carrier in which the rubber hardness (JIS A) was 60 deg., the outer diameter was 20 mm, the thickness of the foam layer was 6 mm, and the resistance was $10^6\Omega$. An aluminum cylinder was subjected to the sand blasting to form a supply member in which the surface roughness in the term of Rz was 20 μm, and the outer diameter was 12.5 mm. The supply member was pressingly contacted with the toner carrier. A regulation member which is a plate made of stainless steel and having a thickness of 3 mm was chamfered at its front end, and pressingly contacted with the toner carrier with a contact pressure of 5 gf/mm. As a result, the driving torques of the toner carrier and the supply member were extremely increased, and the variation of the rotational velocity was produced. It was observed with the naked eye that there were printing jitters which are traversal lines caused by sharp density unevenness. All images were blurred, and many voids were produced in solid images.

The image formation was conducted under the same conditions except that a further developing device configured in the following manner was used. A conductive closed-cell polyurethane foam layer having an average foam cell diameter of about 20 μm was formed on a shaft made of stainless steel, thereby obtaining a toner carrier in which the rubber hardness (JIS A) was 30 deg., the outer diameter was 20 mm, the thickness of the foam layer was 6 mm, and the resistance was $10^6\Omega$. An open-cell polyurethane foam layer was formed on a shaft made of stainless steel as a foamed member having the cell density d of 5 cells/mm (the average foam cell diameter was about 200 μm), thereby forming a supply member in which the rubber hardness (JIS A) was 30 deg., the outer diameter was 12.5 mm, and the thickness of the foam layer was 3.25 mm. The supply member was pressingly contacted with the toner carrier. A regulation member in which the front end of a plate spring made of stainless steel and having a thickness of 0.1 mm was bent into an L-like shape was pressingly contacted with the toner carrier with a contact pressure of 5 gf/mm. As a result, the toner layer on the toner carrier was not sufficiently thinned, so that the background fogging was gradually increased in level as the printing number was increased. Before the printing test was terminated, it was sometimes observed that a foreign body which seemed to be a fragment of the foamed member was on the printed images. When the image forming apparatus was restarted after it was once stopped, the driving torque of the toner carrier was increased and the developing device vibrated. It seems that this was caused by the phenomenon in which the front end of the regulation member bit into the toner carrier. After the printing test, the observation of the regulation member indicated that a small crease was formed in the vicinity of the fixed end of the regulation member.

Twentieth Embodiment

Under the same conditions as Nineteenth Embodiment, the image formation was conducted in the following manner. A conductive closed-cell flexible polyurethane foam layer having an average foam cell diameter of about 20 μm was formed on a shaft made of stainless steel, thereby obtaining a toner carrier in which the rubber hardness (JIS A) was 30 deg., the outer diameter was 20 mm, the thickness of the foam layer was 6 mm, and the resistance according to the resistance measuring method of FIG. 7 was $10^6\Omega$. An acrylic resin in which conductive carbon black was dispersed was injection molded around a shaft made of stainless steel, thereby forming a supply member in which the surface roughness in the term of Rz was 15 μm, and the outer diameter was 12.5 mm. The supply member was pressingly contacted with the toner carrier in such a manner that the center distance between the toner carrier and the supply member was 16 mm. A polyurethane resin in which conductive carbon black was dispersed was injection molded to form a plate-like regulation member of a thickness of 4 mm and having a curved front end. The image formation was conducted while pressing the front end portion was pressingly contacted with the toner carrier with a contact pressure of 5 gf/mm. Dot images of 300 DPI and line images were stably formed without increasing the width of a liner and high resolution images excellent in area gray-scale were formed. Furthermore, clear character images without background fogging were formed, and high-density solid images of an OD value of 1.4 or more and without uneven density were stably formed. The increase in the driving torque and the variation of the rotational velocity of the toner carrier, etc. were not observed. Images of a reduced printing jitter level and a reduced background fogging level were continuously formed. Moreover, the fixation and fusion of the toner to the toner carrier, the supply member and the regulation member were not observed. No damage of the toner was observed.

Twenty-first Embodiment

Under the same conditions as Embodiment 19, the image formation was conducted in the following manner. A conductive closed-cell flexible polyurethane foam layer having an average foam cell diameter of about 20 μm was formed on a shaft made of stainless steel, thereby obtaining a toner carrier in which the rubber hardness (JIS A) was 30 deg., the outer diameter was 20 mm, the thickness of the foam layer was 6 mm, and the resistance according to the resistance measuring method of FIG. 7 was $10^6\Omega$. A magnetic coating material was applied in a thickness of about 100 μm to the outer surface of a cylinder made of aluminum. The magnetization was conducted with a minute pitch, or with a magnetization inversion pitch of about 100 μm, to form a supply member exerting a magnetic attractive force and having an outer diameter of 12 mm. The supply member was contacted with the toner carrier in such a manner that the center distance between the toner carrier and the supply member was 16 mm. A polyurethane resin was injection molded to form a plate-like regulation member of a thickness of 4 mm and having a curved front end. The image formation was conducted while the front end portion of the regulation member was pressingly contacted with the toner carrier a contact pressure of 5 gf/mm. Dot images of 300 DPI and line images were stably formed without increasing the width of a line, and high resolution images excellent in area gray-scale were formed. Furthermore, clear character images without background fogging were formed, and high-density solid images of an OD value of 1.4 or more and without uneven density were stably formed. The driving torque of the toner carrier, etc. was reduced as compared with that in Embodiments 1 and 2, and the variation of the rotational velocity was not observed. Images of a reduced printing jitter level and a reduced background fogging level were continuously formed. Moreover, the fixation and fusion of the toner to the toner carrier, the supply member and the regulation member were not observed. No damage of the toner was observed.

In the above, embodiments of the invention have been described the invention is not restricted to these embodiments, and can be applied to a wide variety of developing devices for an electrophotography system or the like. Particularly, the invention is effective in the application to a printer, a copying machine, or a display device.

As described above, the developing device of the invention comprises: a toner carrier; a supply member which is pressingly contacted with the toner carrier while moving in relative to the toner carrier, so as to supply toner to the toner carrier, the hardness of the toner carrier being greater than at least that of the supply member; and a regulation member which is slidingly contacted with the toner carrier, thereby thinning toner supplied onto the toner carrier. Accordingly, a soft contact developing process using a soft elastic body can be stably conducted so that an image of high resolution and reduced density variation can be formed. Furthermore, the developing device can maintain the toner carry amount on the toner carrier at a constant level irrespective of the residue amount of toner and the printing hysteresis, so that the density unevenness and the printing jitters can be reduced. The main components of the developing device can be constructed by rollers of a simple shape and plate-like members. Therefore, the invention can provide a developing device which is reduced in size and excellent in durability and can be manufactured at a low cost.

What is claimed is:

1. A developing device comprising:

a toner carrier for developing a latent image formed on a latent image carrier, an outer surface of said toner carrier opposing said latent image carrier, at least said outer surface of said toner carrier being formed by a foamed member;

a supply member for supplying toner to said toner carrier, said supply member being pressingly contacted with said toner carrier while moving relative to said toner carrier; and a regulation member for thinning toner supplied onto said toner carrier, said regulation member being slidably contacted with said toner carrier, wherein a hardness of said toner carrier is less than at least that of said supply member.

2. The developing device according to claim 1, wherein said supply member is formed by a rigid member.

3. The developing device according to claim 2, wherein said regulation member is formed by a rigid member.

4. The developing device according to claim 1, wherein the foamed member has a hardness of 40 deg. (JIS A) or less.

5. The developing device according to claim 2, wherein the foamed member has a hardness of 40 deg. (JIS A) or less.

6. The developing device according to claim 3, wherein the foamed member has a hardness of 40 deg. (JIS A) or less.

7. The developing device according to claim 4, wherein said foamed member has a developing nip length of at least 1 mm.

8. The developing device according to claim 5, wherein said foamed member has a developing nip length of at least 1 mm.

9. The developing device according to claim 6, wherein said foamed member has a developing nip length of at least 1 mm.

10. The developing device according to claim 4, wherein said toner carrier exerts a developing pressure of not more than 5 g/mm.

11. The developing device according to claim 5, wherein said toner carrier exerts a developing pressure of not more than 5 g/mm.

12. The developing device according to claim 6, wherein said toner carrier exerts a developing pressure of not more than 5 g/mm.

13. The developing device according to claim 7, wherein said toner carrier exerts a developing pressure of not more than 5 g/mm.

14. The developing device according to claim 8, wherein said toner carrier exerts a developing pressure of not more than 5 g/mm.

15. The developing device according to claim 9, wherein said toner carrier exerts a developing pressure of not more than 5 g/mm.

16. The developing device according to claim 1, wherein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

17. The developing device according to claim 2, wherein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

18. The developing device according to claim 3, wherein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

19. The developing device according to claim 4, wherein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

20. The developing device according to claim 5, wherein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

21. The developing device according to claim 6, wherein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

22. The developing device according to claim 7, therein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

23. The developing device according to claim 8, wherein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

24. The developing device according to claim 9, wherein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

25. The developing device according to claim 10, wherein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

26. The developing device according to claim 11, wherein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

27. The developing device according to claim 12, wherein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

28. The developing device according to claim 13, wherein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

29. The developing device according to claim 14, wherein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

30. The developing device according to claim 15, therein the contacting point between said toner carrier and said supply member is below the rotation center of said toner carrier, the contacting point between said toner carrier and said regulation member is above the rotation center of said toner carrier, an angle defined between a line connecting a rotation center of said toner carrier and a contacting point between said toner carrier and said supply member and a line connecting a rotation center of said toner carrier and said contacting point between said toner carrier and said regulation member is between 45 degrees and 90 degrees.

* * * * *